US008789287B2

(12) United States Patent
Kim et al.

(10) Patent No.: US 8,789,287 B2
(45) Date of Patent: Jul. 29, 2014

(54) CLOTHES TREATING APPARATUS AND FILTER TECHNOLOGY

(75) Inventors: Donghyun Kim, Seoul (KR); Jeongyun Kim, Seoul (KR); Yongju Lee, Seoul (KR); Hyunwoo Noh, Seoul (KR); Sangik Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 246 days.

(21) Appl. No.: 13/102,080

(22) Filed: May 6, 2011

(65) Prior Publication Data

US 2011/0271543 A1 Nov. 10, 2011

(30) Foreign Application Priority Data

| | | |
|---|---|---|
| May 7, 2010 | (KR) | 10-2010-0042760 |
| May 7, 2010 | (KR) | 10-2010-0042761 |
| May 7, 2010 | (KR) | 10-2010-0042780 |
| May 7, 2010 | (KR) | 10-2010-0042796 |
| Jul. 8, 2010 | (KR) | 10-2010-0065803 |
| Jul. 19, 2010 | (KR) | 10-2010-0069514 |
| Jul. 19, 2010 | (KR) | 10-2010-0069515 |
| Aug. 25, 2010 | (KR) | 10-2010-0082476 |
| Sep. 2, 2010 | (KR) | 10-2010-0085893 |
| Sep. 2, 2010 | (KR) | 10-2010-0085896 |

(51) Int. Cl.

| | |
|---|---|
| ***F26B 21/06*** | (2006.01) |
| ***F26B 19/00*** | (2006.01) |
| ***F26B 3/00*** | (2006.01) |
| ***F26B 11/02*** | (2006.01) |

(52) U.S. Cl.

USPC ..... 34/82; 34/85; 34/480; 34/603

(58) Field of Classification Search

USPC ..... 34/85, 90, 603, 82, 79, 587, 480; 55/296

See application file for complete search history.

(56) References Cited

U.S. PATENT DOCUMENTS 2,809,025 A * 10/1957 Pettyjohn ..... 432/68
3,183,647 A * 5/1965 Lang ..... 95/278

(Continued)

FOREIGN PATENT DOCUMENTS

EP 1 719 833 B1 3/2008
EP 2145999 A1 1/2010

(Continued)

OTHER PUBLICATIONS

Korean Notice of Allowance dated Aug. 29, 2012 for Application No. 10-2010-0042799, with English translation, 3 pages.

(Continued)

*Primary Examiner* — Kenneth Rinehart
*Assistant Examiner* — John McCormack
(74) *Attorney, Agent, or Firm* — Fish & Richardson P.C.

(57) ABSTRACT

A clothes treating apparatus includes an accommodating space, an air supply unit, a duct unit and a filter assembly. The accommodating space is configured to receive one or more clothing articles. The air supply unit is configured to supply air to the accommodating space. The duct unit is configured to guide discharge of air from the accommodating space. The filter assembly is positioned to filter air discharged from the accommodating space through the duct unit and includes a housing, a filter positioned in the housing, a substance removal unit and a collection area defined within the housing. The filter positioned in the housing is configured to filter substances from air passing through the filter assembly. The substance removal unit is configured to move substances remaining on a portion of the filter and press the moved substances into the collection area, which is configured to collect removed substances within the housing.

29 Claims, 22 Drawing Sheets

(b)

(56) References Cited

U.S. PATENT DOCUMENTS

| | | | | | |
|---|---|---|---|---|---|
| 4,082,524 | A * | 4/1978 | Noland | 55/294 |
| 4,131,548 | A * | 12/1978 | Peterson | 210/331 |
| 4,314,409 | A * | 2/1982 | Cartier et al. | 34/82 |
| 4,439,218 | A * | 3/1984 | Priepke et al. | 55/288 |
| 4,462,170 | A * | 7/1984 | Burkall et al. | 34/82 |
| 4,700,492 | A * | 10/1987 | Werner et al. | 34/403 |
| 4,831,678 | A * | 5/1989 | Dietsche | 15/176.4 |
| 4,848,105 | A * | 7/1989 | O'Connell et al. | 68/18 F |
| 5,006,136 | A * | 4/1991 | Wetter | 55/290 |
| 5,210,960 | A * | 5/1993 | LaRue | 34/82 |
| 5,217,512 | A * | 6/1993 | Williams | 96/425 |
| 5,463,820 | A * | 11/1995 | La Rue | 34/235 |
| 5,497,563 | A * | 3/1996 | Mayfield | 34/572 |
| 5,701,684 | A * | 12/1997 | Johnson | 34/595 |
| 6,974,487 | B2 * | 12/2005 | Twiefel | 55/289 |
| 7,305,775 | B2 * | 12/2007 | Favret et al. | 34/82 |
| 7,681,420 | B2 * | 3/2010 | Jeong et al. | 68/20 |
| 7,802,375 | B2 * | 9/2010 | Johnson | 34/82 |
| 8,028,439 | B2 * | 10/2011 | Prajescu | 34/601 |
| 8,048,205 | B2 * | 11/2011 | Schaub | 95/277 |
| 8,097,050 | B2 * | 1/2012 | Johnson et al. | 55/289 |
| 8,109,011 | B2 * | 2/2012 | Prajescu | 34/601 |
| 8,156,659 | B2 * | 4/2012 | Jung et al. | 34/79 |
| 8,240,064 | B2 * | 8/2012 | Steffens | 34/480 |
| 8,375,597 | B2 * | 2/2013 | Ahn et al. | 34/82 |
| 8,381,412 | B2 * | 2/2013 | Ahn et al. | 34/82 |
| 2006/0075577 | A1 | 4/2006 | Jeong et al. | |
| 2006/0201014 | A1 * | 9/2006 | Favret et al. | 34/82 |
| 2007/0107250 | A1 * | 5/2007 | Gassmann et al. | 34/82 |
| 2007/0144028 | A1 * | 6/2007 | Audet et al. | 34/82 |
| 2008/0196268 | A1 * | 8/2008 | Jung et al. | 34/603 |
| 2010/0146804 | A1 * | 6/2010 | Ahn et al. | 34/82 |
| 2010/0154241 | A1 * | 6/2010 | Ahn et al. | 34/82 |
| 2010/0192768 | A1 * | 8/2010 | Kim et al. | 95/8 |
| 2011/0154587 | A1 * | 6/2011 | Kim | 15/21.1 |
| 2011/0154675 | A1 * | 6/2011 | Pillot et al. | 34/82 |
| 2011/0173834 | A1 * | 7/2011 | Arrigoni et al. | 34/90 |
| 2011/0225837 | A1 * | 9/2011 | Ahn et al. | 34/82 |
| 2011/0225838 | A1 * | 9/2011 | Ahn et al. | 34/82 |
| 2011/0258872 | A1 * | 10/2011 | Kim et al. | 34/85 |
| 2011/0271543 | A1 * | 11/2011 | Kim et al. | 34/90 |
| 2011/0271550 | A1 * | 11/2011 | Kim et al. | 34/480 |
| 2012/0084992 | A1 * | 4/2012 | Shin et al. | 34/82 |
| 2012/0090189 | A1 * | 4/2012 | Kwon et al. | 34/82 |
| 2012/0102777 | A1 * | 5/2012 | Dendel | 34/353 |
| 2012/0144687 | A1 * | 6/2012 | Yeom | 34/82 |
| 2012/0180534 | A1 * | 7/2012 | Cho et al. | 68/18 R |

FOREIGN PATENT DOCUMENTS

| | | | | |
|---|---|---|---|---|
| EP | 2146000 | A1 | 1/2010 | |
| JP | 06-098993 | A | 4/1994 | |
| JP | 08-280996 | A | 10/1996 | |
| JP | 2008-006045 | A | 1/2008 | |
| JP | 2010-155032 | A | 7/2010 | |
| KR | 10-0140017 | B1 | 7/1998 | |
| KR | 10-2004-0006233 | A | 1/2004 | |
| KR | 10-2004-0011216 | A | 2/2004 | |
| KR | 10-0651856 | B1 | 11/2006 | |
| KR | 10-2009-002564 | B1 | 1/2009 | |
| KR | 10-0902564 | B1 | 6/2009 | |
| KR | 10-2009-0102415 | A | 9/2009 | |
| KR | 10-2010-0070019 | A | 6/2010 | |
| WO | WO 2010/071355 | * | 12/2008 | D06F 58/22 |
| WO | WO 2009/015919 | A1 | 2/2009 | |

OTHER PUBLICATIONS

PCT International Search Report and Written Opinion dated Apr. 20, 2012 for Application No. PCT/KR2011/003348, 11 pages.

PCT International Search Report and Written Opinion dated May 14, 2012 for Application No. PCT/KR2011/003339, 11 pages.

Taiwan Office Action dated Dec. 6, 2013 for Application No. 100115746, in English, 22 pages.

Russian Office Action dated Sep. 13, 2013 for Application No. 2012150276, with English Translation, 6 pages.

* cited by examiner (a)

(b)

(a)

(b)

(a)

(b)

(a)

(b)

(a)

(b)

CLOTHES TREATING APPARATUS AND FILTER TECHNOLOGY

CROSS-REFERENCE TO RELATED APPLICATIONS

This application claims the benefit of Korean Patent Application No. 10-2010-0042760 filed on May 7, 2010, Korean Patent Application No. 10-2010-0042796 filed on May 7, 2010, Korean Patent Application No. 10-2010-0042780 filed on May 7, 2010, Korean Patent Application No. 10-2010-0042761 filed on May 7, 2010, Korean Patent Application No. 10-2010-0069514 filed on Jul. 19, 2010, Korean Patent Application No. 10-2010-0085893 filed on Sep. 2, 2010, Korean Patent Application No. 10-2010-0065803 filed on Jul. 8, 2010, Korean Patent Application No. 10-2010-0069515 filed on Jul. 19, 2010, Korean Patent Application No. 10-2010-0085896 filed on Sep. 2, 2010 and Korean Patent Application No. 10-2010-0082476 filed on Aug. 25, 2010, all of which are incorporated herein by reference in their entirety.

TECHNICAL FIELD

The following disclosure relates generally to clothes treating apparatus and filter technology.

BACKGROUND

In general, a clothes treating apparatus performs washing, drying, or both washing and drying of clothes. Clothes treating apparatus may include washing machines, drying machines and washing/drying machines.

SUMMARY

Figure 1:
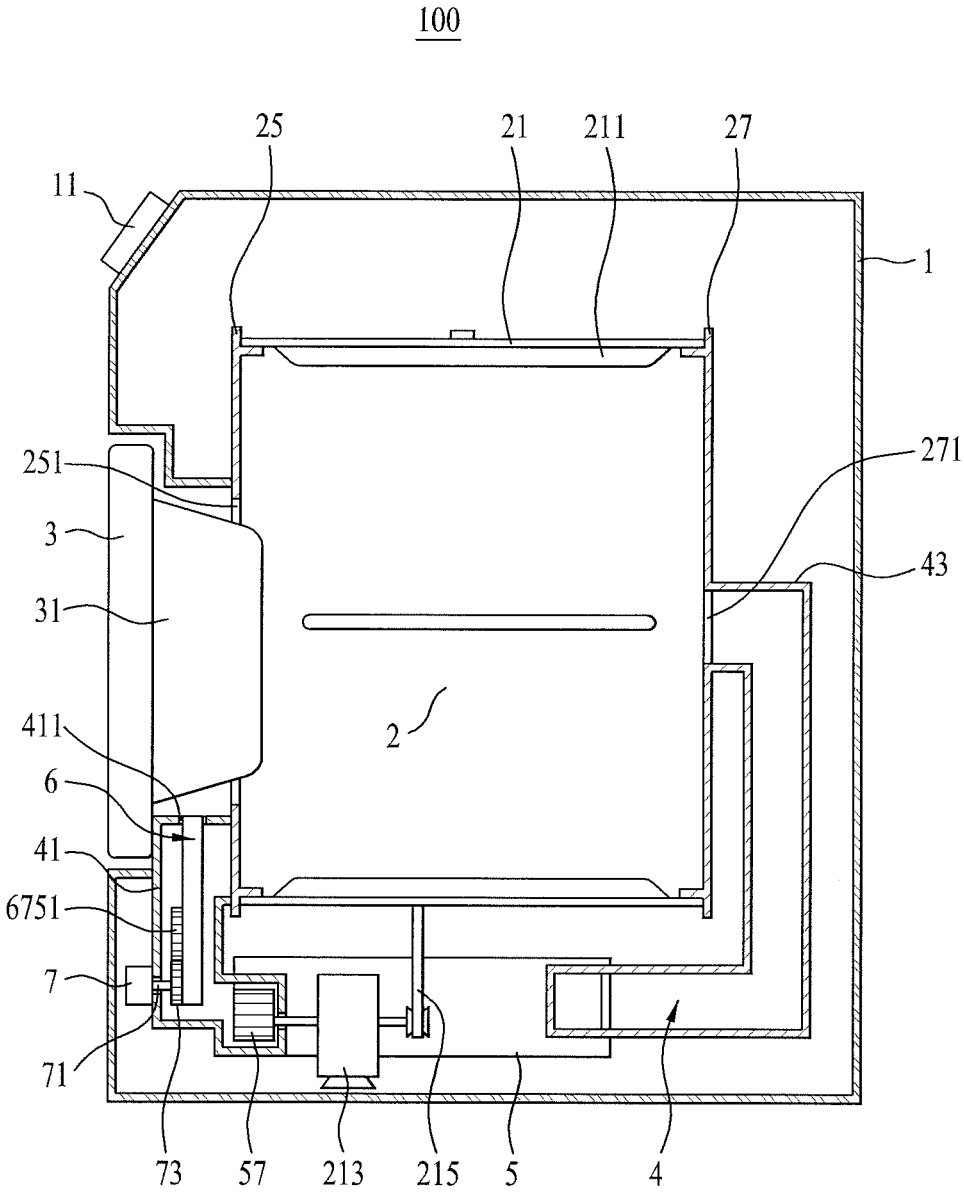
FIG. 1 illustrates an example clothes treating apparatus.

In a general aspect, a clothes treating apparatus includes an accommodating space, an air supply unit, a duct unit and a filter assembly. The accommodating space is configured to receive one or more clothing articles. The air supply unit is configured to supply air to the accommodating space. The duct unit is configured to guide discharge of air from the accommodating space. The filter assembly is positioned to filter air discharged from the accommodating space through the duct unit, wherein the filter assembly includes a housing, a filter positioned in the housing, a substance removal unit and a collection area defined within the housing. The filter positioned in the housing of the filter assembly is configured to filter substances from air passing through the filter assembly. The substance removal unit is configured to move substances remaining on a portion of the filter and press substances moved from the filter into the collection area, the collection area being configured to collect removed substances within the housing.

Particular implementations may include one or more of the following features. For example, the substance removal unit may be configured to compress substances collected in the collection area defined within the housing. The collection area may include an overlapping portion that overlaps with the portion of the filter from which substances are moved from the filter by the substance removal unit, the overlapping portion being less than all of the collection area, and a non-overlapping portion that does not overlap with the portion of the filter from which substances are moved from the filter by the substance removal unit, the non-overlapping portion being less than all of the collection area. The substance removal unit may compress substances collected in the collection area by pressing substances in the overlapping portion of the collection area toward the non-overlapping portion of the collection area.

The substance removal unit may include a rotating arm that is attached to a brush. The rotating arm may be configured to rotate back and forth over an angle range that covers less than all of an area covered by the filter. The brush may be configured to move substances remaining on the portion of the filter over which the rotating arm rotates into the collection area.

The substance removal unit may include an air generator that is configured to blow air over a portion of the filter that is less than all of an area covered by the filter. The air may be blown by the air generator such that substances remaining on the portion of the filter over which the air is blown is moved into the collection area.

The substance removal unit may be configured to rotate within an angle range that covers less than all of the filter, the angle range being set such that a rotation area of the substance removal unit overlaps with a section of the collection area. The substance removal unit may rotate back and forth over the angle range such that the substance removal unit presses substances moved from the filter into a first side of the collection area when rotating in a clockwise direction and presses substances moved from the filter into a second side of the collection area when rotating in a counterclockwise direction.

The filter positioned in the housing of the filter assembly may be a first filter unit. The filter assembly may include a second filter unit that is different from the first filter unit. The second filter unit may be configured to filter substances from air passing through the filter assembly. The substance removal unit may be positioned between the first filter unit and the second filter unit when the first filter unit and the second filter unit are assembled in the filter assembly. The substance removal unit may be configured to move substances remaining on the first filter unit and the second filter unit and press substances moved from the first filter unit and the second filter unit into the collection area defined within the housing.

The first filter unit may have a first circular shape with a first radius of curvature, while the second filter unit may have a second circular shape with a second radius of curvature that is different than the first radius of curvature. The first filter unit may be connected with the second filter unit when the first filter unit and the second filter unit are assembled in the filter assembly. The collection area may be located at a portion of the filter assembly that has a circular arc with a largest radius of curvature.

The first filter unit and the second filter unit each may be rectangular in shape. The substance removal unit may be coupled to each filter unit at a center of one side of each filter unit. The first filter unit and the second filter unit each may be semi-circular in shape. The substance removal unit may be coupled to each filter unit at a diametric center of each filter unit.

The housing may include a discharge hole through which the substances located in the collection area are discharged to the outside of the housing. The filter assembly may include a suction device configured to suck the substances located in the housing through the discharge hole. The duct unit may include a suction hole into which air discharged from the accommodating space is introduced. The housing may be coupled to the duct unit through the suction hole, and may include an inflow surface that is connected to the suction hole and through which air is introduced into the housing. The housing may include a first housing part provided with an inflow surface that is connected to the suction hole and through which air is introduced into the housing and a second housing part connected to the first housing by a hinge. The first filter unit and the second filter unit may be respectively coupled to the first housing part and the second housing part.

The substance removal unit may include a brush provided within the housing such that the brush is in physical contact with the first filter unit and the second filter unit. The substance removal unit may further include a brush rotating shaft coupled to the first filter unit and the second filter unit and connected to the brush to rotate the brush. The clothes treating apparatus may include a motor external to the housing and including a motor rotating shaft. The clothes treating apparatus also may include gears connecting the brush rotating shaft with the motor rotating shaft. The motor rotating shaft may be placed at an angle with respect to the position of the brush rotating shaft. The angle of placement of the motor rotating shaft with respect to the position of the brush rotating shaft may have a value that is within a range of 30 to 60 degrees.

The gears may include a driven gear attached to the brush rotating shaft and placed on the outside of the housing and a driving gear attached to the motor rotating shaft and engaged with the driven gear. The gears may include a driven gear attached to the brush rotating shaft and placed on the outside of the housing, a driving gear attached to the motor rotating shaft and a connection gear placed within the duct unit that connects the driven gear and the driving gear.

The brush may include bristles of varying length. The collection area may include a collection unit coupled to the housing, wherein the collection unit can be detached from the housing as a physically distinct unit.

The clothes treating apparatus may include a fluid supply unit to supply a fluid into the collection area. The housing may include an inlet hole connected to the fluid supply unit and a discharge hole to discharge the substances stored in the collection area to the outside of the housing.

The duct unit may include a suction hole into which air discharged from the accommodating space is introduced. The housing may be coupled to the duct unit through the suction hole and may include an inflow surface that is connected to the suction hole and through which air is introduced into the housing. The collection area may include a collection unit coupled to the housing, the inflow surface and the suction hole being coupled to the collection unit. The duct unit may include a discharge duct into which air removed from the accommodating space is introduced and a supply duct that is connected to the discharge duct and configured to guide air into the accommodating space. The air supply unit may include a condensing part that is configured to remove moisture from the air introduced into the discharge duct and a heating part to heat the air from which moisture has been removed, the air supply unit configured to supply the heated air to the supply duct. The fluid supply unit may include a water supply pipe configured to supply condensation water, generated by the condensing part, to the inlet hole.

The clothes treating apparatus may include a sensing unit configured to determine whether an amount of substances collected in the collection area exceeds a predetermined reference storage amount. The clothes treating apparatus may further include a display unit to inform a user, based on information supplied from the sensing unit, that the amount of the substances collected in the collection area exceeds the reference storage amount. The sensing unit may include an angle detection unit configured to sense whether the substance removal unit is rotated within an angle range smaller than a predetermined angle range. Alternatively, the sensing unit may include a weight sensor configured to measure a weight of the substances collected in the collection area. Alternatively, the sensing unit may include an infra-red (IR) sensor configured to intercept an IR beam in the collection area.

In another general aspect, a clothes treating apparatus includes an accommodating space, an air supply unit, a duct unit, a filter housing that includes a first filter unit and a second filter unit and a brush positioned within the filter housing between the first filter unit and the second filter unit. The accommodating space is configured to receive one or more clothing articles. The air supply unit is configured to supply air to the accommodating space. The duct unit is configured to guide discharge of air from the accommodating space.

The filter housing includes a first side with the first filter unit, a second side with the second filter unit, and one or more air inlets that allow air discharged from the accommodating space through the duct unit to enter the filter housing and pass through the first filter unit and the second filter unit. The first filter unit and the second filter unit are configured to filter substances from air passing through the filter housing and the first side of the filter housing is configured to attach to and detach from the second side of the filter housing.

The brush is positioned within the filter housing between the first filter unit and the second filter unit when the first side of the filter housing is attached to the second side of the filter housing. The brush is configured to rotate back and forth over an angle range that covers less than all of the first filter unit and the second filter unit and brush substances remaining on the first filter unit and the second filter unit toward a collection area defined within the filter housing and located at a portion of the filter housing outside of the angle range through which the brush rotates. The brush is further configured to compress substances into the collection area as substances brushed from the first filter unit and the second filter unit fill the collection area and expand into the angle range through which the brush rotates.

Particular implementations may include one or more of the following features. For example, the collection area may include an overlapping portion that overlaps with the portion of the filter housing from which substances are moved from the first filter unit and the second filter unit by the brush, the overlapping portion being less than all of the collection area. The collection area may include a non-overlapping portion that does not overlap with the portion of the filter housing from which substances are moved from the first filter unit and the second filter unit by the brush, the non-overlapping portion being less than all of the collection area. The brush may be configured to compress substances collected in the collection area by pressing substances in the overlapping portion of the collection area toward the non-overlapping portion of the collection area.

The brush may be configured to rotate back and forth over the angle range such that the brush presses substances moved from the first filter unit and the second filter unit into a first side of the collection area when rotating in a clockwise direction and presses substances moved from the first filter unit and the second filter unit into a second side of the collection area when rotating in a counterclockwise direction.

The first filter unit may have a first circular shape with a first radius of curvature. The second filter unit may have a second circular shape with a second radius of curvature that is different than the first radius of curvature. The first filter unit may be connected with the second filter unit when the first filter unit and the second filter unit are assembled in the filter housing. The collection area may be located in a portion of the filter housing having a circular arc with a largest radius of curvature.

The first filter unit and the second filter unit each may be rectangular in shape. The substance removal unit may be coupled to each filter unit at a center of one side of each filter unit. The first filter unit and the second filter unit each may be semi-circular in shape. The brush may be coupled to each filter unit at a diametric center of each filter unit.

The filter housing may include a discharge hole through which the substances located in the collection area are discharged to the outside of the filter housing. The filter housing may further include a suction device configured to suck the substances located in the filter housing through the discharge hole.

DETAILED DESCRIPTION

Clothes treating apparatus capable of drying clothes may be classified into two categories based on air flow methods to supply air at a high temperature (hot air) to clothes: an exhaust type clothes treating apparatus and a circulation type (condensation type) clothes treating apparatus. In the circulation type clothes treating apparatus, air in an accommodating space, in which clothes are placed, is circulated such that air discharged from the accommodating space is dehumidified and heated and then the dehumidified and heated air is re-supplied to the accommodating space. In the exhaust type clothes treating apparatus, heated air is supplied to an accommodating space such that air discharged from the accommodating space is not circulated and is discharged to the outside of the clothes treating apparatus.

In case of the circulation type clothes treating apparatus, since the air discharged from the accommodating space is dehumidified and heated by a heat exchanger and is then re-supplied to the accommodating space, if foreign substances are not removed from the air discharged from the accommodating space, the foreign substances are accumulated in the heat exchanger and thus heat exchange efficiency may be lowered.

In case of the exhaust type clothes treating apparatus, if air is discharged from the accommodating space without being filtered, lint or dust contained in the discharged air may be supplied to an indoor space provided with the clothes treating apparatus.

Therefore, it may be desirable to filter air discharged from an accommodating space of clothes treating apparatus capable of drying clothes. A filter is hence provided in a clothes treatment apparatus to filter foreign substances from the air exhausted from the accommodating space. A mechanism may be provided in the clothes treatment apparatus that enables the filter to be cleaned automatically, thereby removing the requirement for a user to check the state of the filter before or after the clothes treatment apparatus is used.

FIG. 1 illustrates an example of a clothes treating apparatus. Hereinafter, with reference to FIG. 1, a general configuration of the clothes treating apparatus will be described.

A clothes treating apparatus 100 in accordance with the present disclosure includes a cabinet 1 forming the external appearance of the clothes treating apparatus 100 and an accommodating space 2 formed in the cabinet 1 to receive clothes.

The accommodating space 2 includes a drum 21 to provide a space to receive an object to be dried, e.g., clothes, and the drum 21 has a cylindrical shape provided with opened front and rear surfaces.

A front support part 25 to support the opened front surface of the drum 21 is provided at the front portion of the drum 21, and a rear support part 27 to support the opened rear surface of the drum 21 is provided at the rear portion of the drum 21.

The front support part 25 is provided with an opening 251 through which clothes are put into the drum 21 or are taken out of the drum 21, and the opening 251 is opened and closed by a door 3 rotatably provided on the cabinet 1.

The door 3 includes a door glass 31 extended in the direction of the opening 251. The door glass 31 guides laundry moving in the direction of the door 3 to the inside of the drum 21 during rotation of the drum 21 as well as allows a user to observe the inside of the drum 21 during operation of the clothes treating apparatus.

The rear support part 27 is provided with a supply hole 271 through which external air is introduced into the drum 21, and the supply hole 271 is connected to a supply duct 43 which will be described later.

The drum 21 supported by the front support part 25 and the rear support part 27 is rotated by a drum motor 213 and a belt 215, and lifters 211 facilitating tumbling of an object to be dried are further provided on the inner circumferential surface of the drum 21.

The clothes treating apparatus in accordance with the present disclosure further includes a duct unit 4 and an air supply unit 5 to supply air (e.g., hot air) to laundry received in the drum 21.

The duct unit 4 includes a discharge duct 41 to discharge air from the drum 21 and a supply duct 43 to supply air to the inside of the drum 21.

The discharge duct 41 is provided with a suction hole 411 into which the air discharged from the drum 21 is introduced. The supply duct 43 communicates with the discharge duct 41 and is connected to the supply hole 271 of the rear support part 27, thereby supplying air having passed through the air supply unit to the inside of the drum 21.

In case of a circulation type clothes treating apparatus, the discharge duct 41 and the supply duct 43 may be connected to each other so as to form one channel. The air supply unit 5 includes a fan 57 to blow air, a condensing part to dehumidify air flowing within the duct unit 4, and a heating part to heat the dehumidified air.

The fan 57 is an air circulation device to cause air in the drum 21 to be introduced into the discharge duct 41. The fan 57 may be rotated by the drum motor 213.

When the fan 57 is rotated, air in the duct unit 4 flows to the inside of the drum 21. When the air in the duct unit 4 is introduced into the drum 21, the air in the drum 21 is introduced into the discharge duct 41 through the suction hole 411.

While the air introduced into the discharge duct 41 flows in the direction of the supply duct 43 via the air supply unit 5, the air is dehumidified and heated, thereby drying the clothes in the drum 21.

In the circulation type clothes treating apparatus, foreign substances, such as lint, may be discharged from clothes during a drying process of the clothes, and the foreign substances discharged from the clothes are circulated along the duct unit 4. Therefore, if foreign substances are not filtered out from air discharged from the drum 21, the foreign substances are adhered to the surface of a heat exchanger, such as the condensing part or the heating part, thereby lowering drying efficiency of the clothes treating apparatus.

In an attempt to address the problem, the clothes treating apparatus in accordance with the present disclosure further includes a filter assembly 6 to filter out foreign substances from air circulated along the duct unit 4 so as to reduce lowering of a flow rate of air due to the foreign substances as well as lowering of drying efficiency.

The filter assembly 6 may be detachably provided on the suction hole 411 of the discharge duct 41. In this case, a user may separate the filter assembly 6 from the clothes treating apparatus or connect the filter assembly 6 to the clothes treating apparatus after opening of the door 3.

The above-described connection structure between the filter assembly 6 and the discharge duct 4 is provided on the circulation type clothes treating apparatus to dry clothes. However, such a connection structure between the filter assembly 6 and the discharge duct 4 may be applied to a clothes treating apparatus being capable of washing and drying clothes and an exhaust type clothes treating apparatus for the purpose of only drying clothes.

Figure 22:
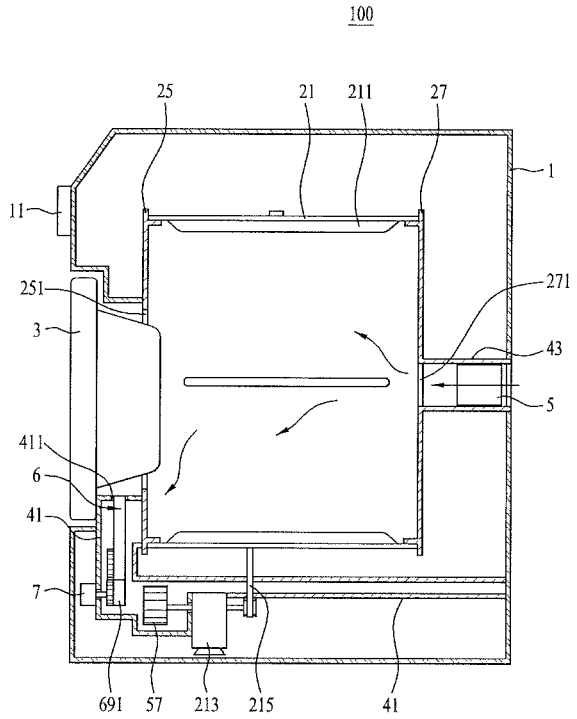
FIGS. 22 and 23 illustrate examples of clothes treating apparatus to which a filter assembly is applicable.

That is, the above-described filter assembly 6 may be applied to an exhaust type clothes treating apparatus (for the purpose of only drying clothes) shown in FIG. 22.

In the exhaust type clothes treating apparatus as shown in FIG. 22, air at the outside of an accommodating space is heated by the air supply unit 5 and the heated air is supplied to the inside of the accommodating space (e.g., the drum 21) such that air discharged from the accommodating space 21 is discharged to the outside of the clothes treating apparatus.

Therefore, in case of the exhaust type clothes treating apparatus, the air supply unit 5 is separately provided in the discharge duct 41 to discharge air from the drum 21 and the supply duct 43 to supply air to the inside of the drum 21.

In this case, the filter assembly 6 is detachably attached to the suction hole 411 of the discharge duct 41, and the heating part and the condensing part of the air supply unit 5 is provided in the supply duct 43. Although FIG. 22 illustrates the supply duct 43 as communicating with the outside of the cabinet 1, the supply duct 43 may be provided so as to supply air at the inside of the cabinet 1 to the inside of the drum 21.

Figure 23:
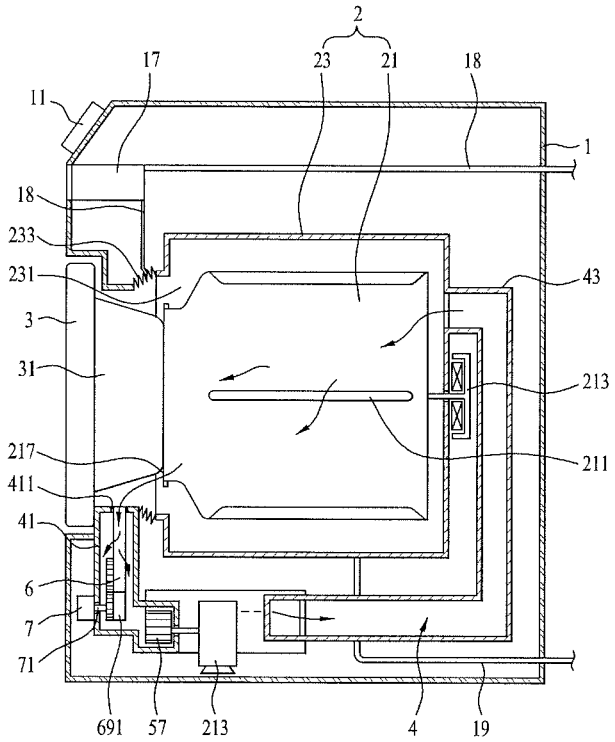

FIG. 23 illustrates a circulation type clothes treating apparatus that is capable of washing and drying clothes.

As shown in FIG. 23, in some implementations, a tub 23, in which a drum 21 is provided, and which stores wash water, is provided within a cabinet 1. Therefore, in the clothes treating apparatus that is capable of washing and drying clothes, an accommodating space 2 includes the tub 23 and the drum 21.

In order to put and take clothes into and out of the accommodating space 2, the tub 23 is provided with a tub opening 231 and the drum 21 is provided with a drum opening 217 communicating with the tub opening 231.

Further, this structure includes a supply hose 18 to supply wash water to the tub 23 and a drain hose 19 to drain the tub 23. The supply hose 18 is connected to the tub 23 via a detergent box 17.

In some implementations, a space between the tub 23 and the cabinet 1 is sealed by a gasket 233, and a discharge duct 41 is connected to the front surface of the tub 23 and a supply duct 43 is connected to the rear surface of the tub 23.

However, differing from FIG. 23, the supply duct 43 may be located at any position where air is supplied to the tub 23 through the front surface of the tub 23.

A filter assembly 6 may be detachably provided at a suction hole 411 of the discharge duct 41. A drum motor 213 to rotate the drum 21 may be provided so as to simultaneously rotate a fan 57 and the drum 21 in the same manner as in FIG. 1, or be provided so as to rotate the drum 21 alone as shown in FIG. 23.

In case of the former, a driving pulley is provided on the drum motor 213 and a driven pulley connected to the driving pulley by a belt is provided on the rear surface of the tub 23. Here, the driven pulley is fixed to the rear surface of the drum 21 through a rotary shaft.

Although not shown in the drawings, in case of an exhaust type clothes treating apparatus being capable of washing and drying clothes, a supply duct and a discharge duct are separated from each other in the same manner as in FIG. 22, and thus a detailed description thereof will be omitted.

Figure 2:
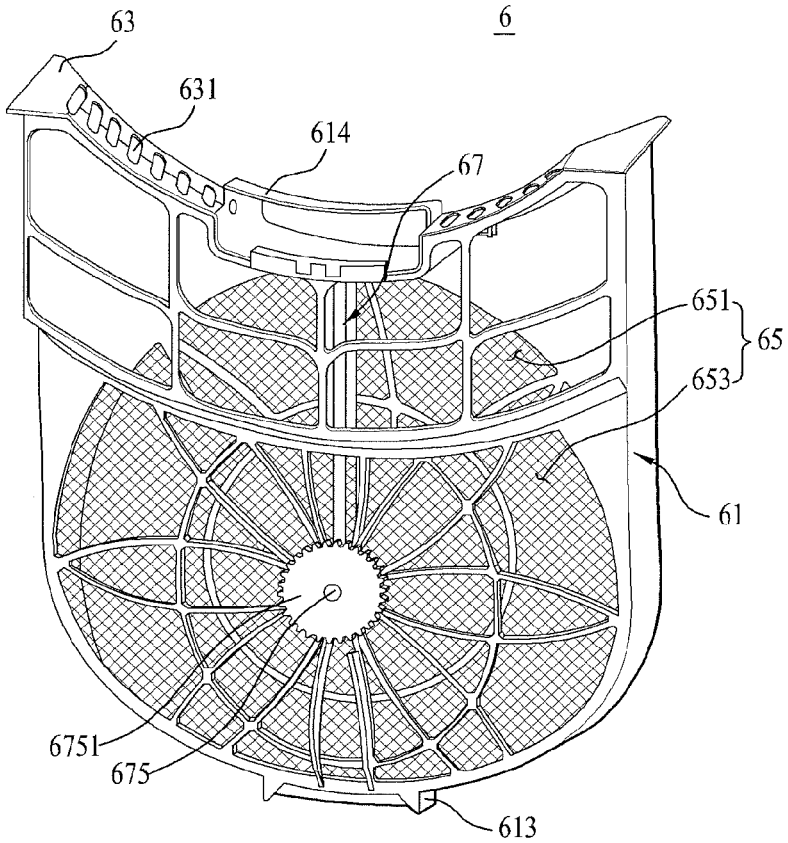
FIGS. 2A and 2B illustrate an example filter assembly.
Figure 2:
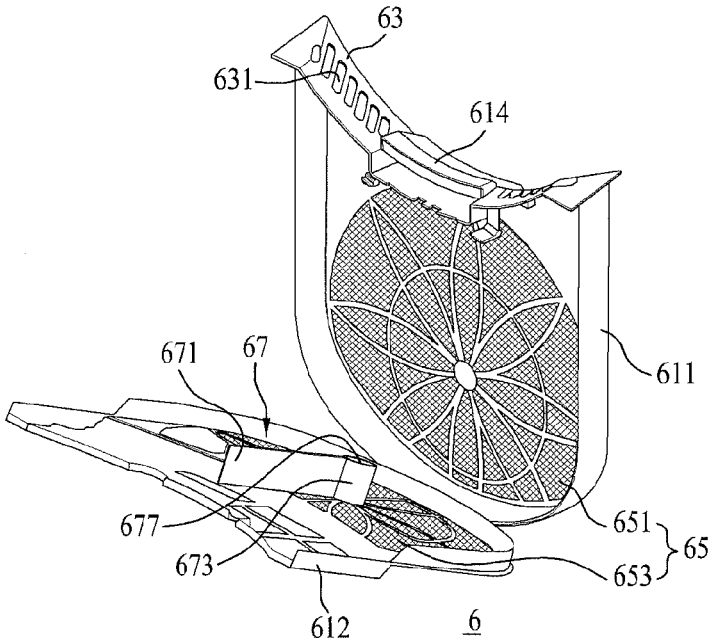
Figure 3:
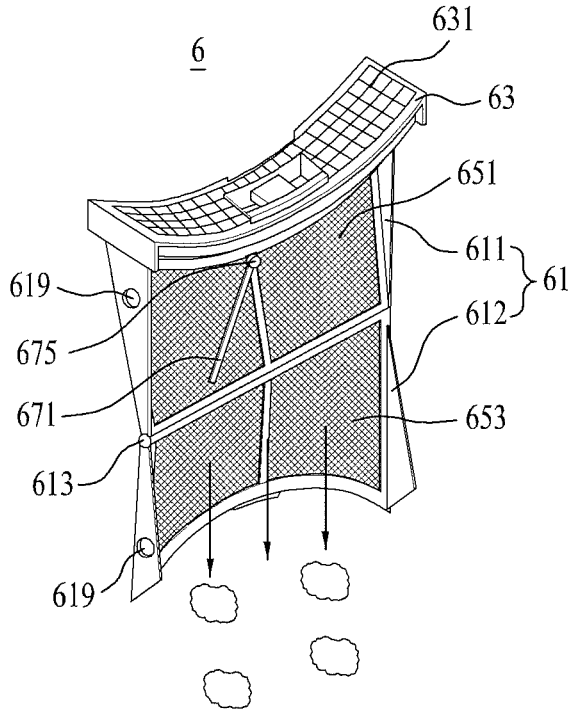
FIG. 3 illustrates an example filter assembly.

FIGS. 2A, 2B and FIG. 3 illustrate an example filter assembly. The filter assembly 6 includes a housing 61 detachably provided on the suction hole 411 of the discharge duct 41, an inflow surface 63 communicating with the suction hole 411 and allowing air to be introduced into the housing 61, filter units 65 to filter out foreign substances, such as lint, introduced into the housing 61, and a foreign substance removal unit 67 to move foreign substances remaining on the filter units 65 to one side (e.g., a storage space) of the inside of the housing 61 and then to compress the foreign substances.

The housing 61 includes a first housing part 611 and a second housing part 612 which are connected to each other by a hinge 613, as shown in FIGS. 2A and 2B.

In this case, the inflow surface 63 may be provided on the upper surface of one of the first housing part 611 and the second housing part 612. FIGS. 2A and 2B illustrate the inflow surface 63 as being provided on the upper surface of the first housing part 611.

The inflow surface 63 may be formed in a shape corresponding to the shape of the suction hole 411 provided on the discharge duct 41, and a plurality of inflow holes 631 to guide air introduced into the suction hole 411 to the inside of the housing 61.

The filter units 65 serve to remove foreign substances from air discharged from the accommodating space and then to supply the air, from which the foreign substances are removed, to the duct unit 4. The filter units 65 are provided on at least one surface of the housing 61.

That is, the filter units 65 may be provided as a mesh shape which removes foreign substances from air introduced into the housing 61 and then allows the air, from which the foreign substances are removed, to flow along the duct unit 4.

The filter assembly 6 in accordance with the present disclosure includes a pair of filters respectively provided at both opposite ends of the inflow surface 63 so as to increase a filtration capacity (e.g., an amount of air passing through the filter assembly 6).

That is, the filter units 65 may be a first filter 651 provided on the first housing part 611 and a second filter 653 provided on the second housing part 612.

In this case, since the first housing part 611 and the second housing part 612 are connected by the hinge 613, if a large amount of foreign substances are stored within the filter assembly 6, a user separates the first housing part 611 and the second housing part 612 from each other and then removes the foreign substances stored within the filter assembly 6.

The foreign substance removal unit 67 is rotatably provided within the housing 61 and serves to move foreign substances remaining on the filter units 65 to one side of the inside of the housing 61 and then to compress the foreign substances.

For this purpose, the foreign substance removal unit 67 includes a brush 671 contacting the filter units 65, a brush frame 673 to which the brush 671 is fixed, a brush rotating shaft 675 to receive drive power from a motor 7 (see, for example, FIGS. 4A and 4B), which are described in more detail later, and then to transmit the received drive power to the brush frame 673, and a shaft insertion hole 677 provided on the brush frame 673 such that the brush rotating shaft 675 is inserted into the shaft insertion hole 677.

For instance, the brush rotating shaft 675 passes through the filter unit 65 and is inserted into the shaft insertion hole 677 of the brush frame 673, and a driven gear 6751 located at the outside of the housing 61 is connected to the brush rotating shaft 675, as shown in FIG. 2.

The driven gear 6751 is engaged with a driving gear 73 provided on the motor 7 (see, for example, FIGS. 4*a* and 4*b*) provided at the outside of the housing 61.

In an alternative implementation, the foreign substance removal unit 67 includes an air generator that blows air over the filter unit 65. The air generator blows air over the filter unit such that the air is blown only over a portion of the air covered by the first filter 651 and the second filter 653. Foreign substances are removed from the portion of the filter unit 65 over which the air is blown by the air generator, such that the foreign substances are moved to one side of the inside of the housing 61 and then compressed by the force of the air blown by the air generator.

Different from that shown in FIG. 2, a gap between the first housing part 611 and the second housing part 612 may be gradually decreased in the direction from the inflow surface 63 to the hinge 613 (see FIG. 3). This serves to allow foreign substances to be stacked on the lower portion of the housing 61 because air introduced into the housing 61 through the inflow surface 63 is discharged to the outside of the housing 61 via the first filter 651 and the second filter 653.

Figure 4:
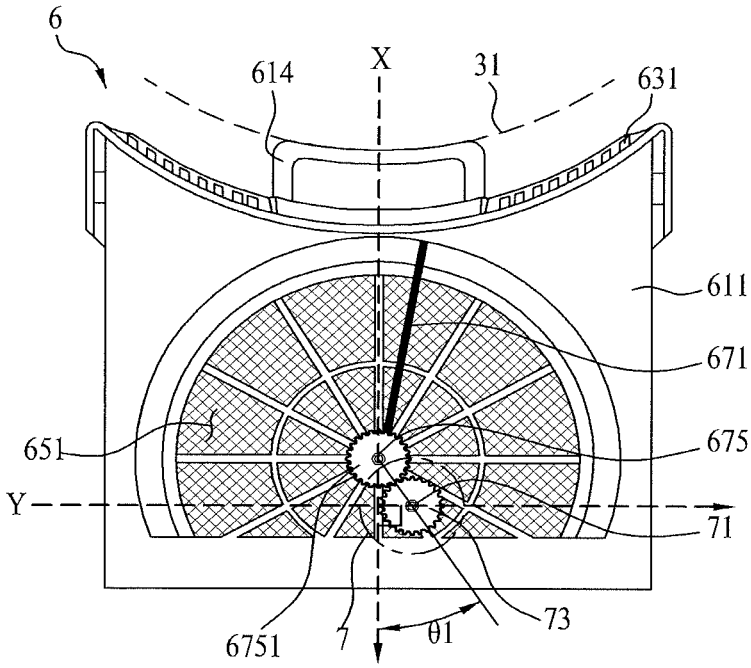
FIGS. 4A and 4B illustrate various connection structures between a foreign substance removal unit and a motor.
Figure 4:
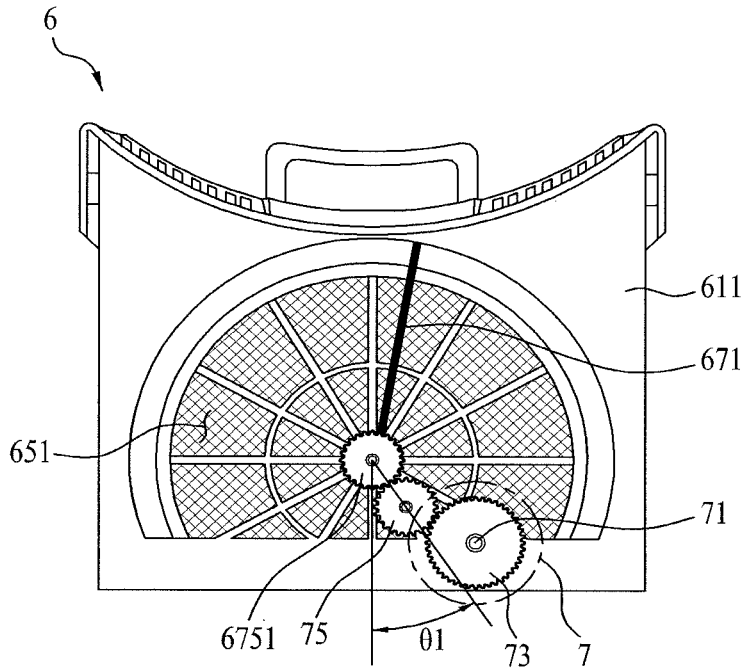

As shown in FIGS. 4A and 4B, the motor 7 includes a motor rotating shaft 71 and the driving gear 73 connected to the motor rotating shaft 71. The motor 7 may be provided at a position at which the driven gear 6751 is engaged with the driving gear 73 when the filter assembly 6 is inserted into the suction hole 411 of the discharge duct 4.

Therefore, when the motor 7 is operated, the driven gear 6751 is rotated by the driving gear 73 and the brush rotating shaft 675 is rotated by the driven gear 6751. Since the brush rotating shaft 675 is fixed to the shaft insertion hole 677 provided on the brush frame 673, the brush 671 fixed to the brush frame 673 is also rotated within the housing 61 when the motor 7 is rotated.

Further, the driving gear 73 and the driven gear 6751 may be connected through a connection gear 75, as shown in FIG. 4B.

This connection structure serves to transmit drive power of the motor 7 to the foreign substance removal unit 67 if it is difficult to engage the driving gear 73 provided on the motor rotating shaft 71 directly with the driven gear 6751 due to a structural arrangement of the clothes treating apparatus.

In some implementations, the motor rotating shaft 71 is provided at a position separated from the insertion direction (X) of the brush rotating shaft 675 by a designated angle θ1. That is, the motor rotating shaft 71 and the brush rotating shaft 675 may not be provided on a straight line.

The filter assembly 6 is inserted into the discharge duct 41 through the suction hole 411. Here, if the driven gear 6751 and the driving gear 73 are located on a straight line, teeth of the driving gear 73 and teeth of the driven gear 6751 may not be correctly engaged with each other.

Although the teeth of the driving gear 73 and the teeth of the driven gear 6751 are not correctly engaged with each other, when the filter assembly 6 is inserted into the discharge duct 41, the teeth of the driving gear 73 and the teeth of the driven gear 6751 may be damaged. The above-described structure may address this issue.

That is, when the center of rotation of the driving gear 73 and the center of rotation of the driven gear 6751 are separated from each other by a designated distance in the direction Y perpendicular to the insertion direction X of the filter assembly 6, the above issue may be addressed.

The angle θ1 between the motor rotating shaft 71 and the brush rotating shaft 675 may be in the range of approximately 10~80 degrees with respect to the insertion direction of the filter assembly 6, and preferably be in the range of 30~60 degrees.

If the driving gear 73 and the driven gear 6751 are connected by the connection gear 75, as shown in FIG. 4B, the center of rotation of the connection gear 75 and the center of rotation of the driven gear 6751 may be connected in the above angle range.

Hereinafter, a structure to fix connection between the filter assembly 6 and the discharge duct 41 will be described with reference to FIG. 5 and FIGS. 6A and 6B.

Since the foreign substance removal unit 67 rotated by drive power transmitted from the motor 7 is provided within the housing 61, as described above, if the filter assembly 6 is not fixed to the suction hole 411, the filter assembly 6 may be separated from the suction hole 411 when the motor 7 is operated.

That is, the driven gear 6751 receives drive power transmitted from the driving gear 73 when the motor 7 is rotated, and if the filter assembly 6 is not fixed to the suction hole 411, the filter assembly 6 may be separated from the discharge duct 41. Therefore, a structure may be used to restrict the housing 61 from being separated from the suction hole 411.

For this purpose, the housing 61 of the filter assembly 6 may be provided so as to apply pressure to the inside of the discharge duct 41 by the glass 31 when the door 3 is closed.

Figure 5:
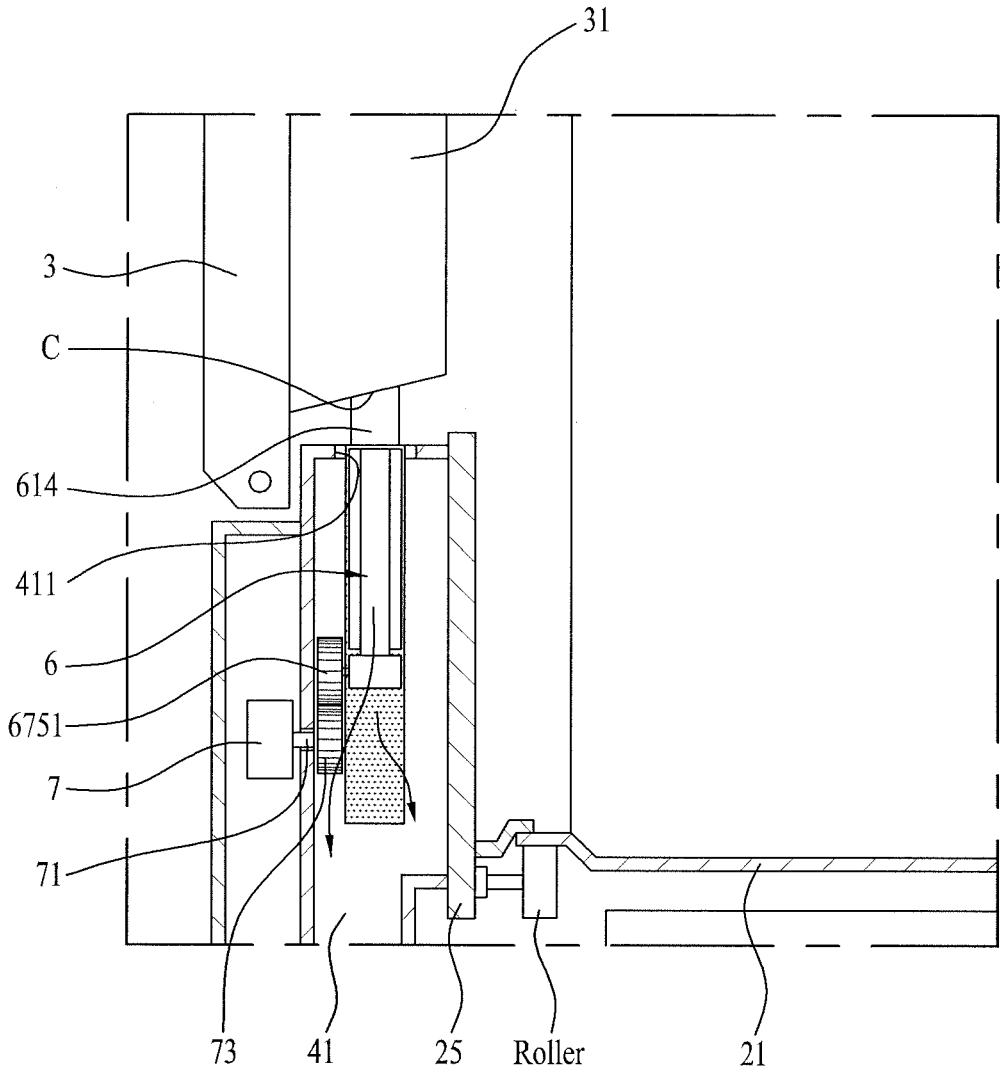
FIG. 5 is a view illustrating a structure of the filter assembly fixed by a door.

That is, the housing 61 may further include a protrusion 614 protruded from the inflow surface 63, as shown in FIG. 5.

In this case, the protrusion may have a length that is long enough to contact the glass 31 when the door 3 is closed and has the same radius of curvature as the radius of curvature of the glass 31.

Further, the protrusion may be inclined at a designated angle C so as not to disturb opening and closing of the door 3.

The protrusion may be a handle 614 provided with a space to receive a user's hand (see, for example, FIGS. 4A and 4B). The handle 614 serves to facilitate attachment and detachment of the filter assembly 6 to and from the discharge duct 41 as well as to restrict movement of the filter assembly 6.

Figure 6:
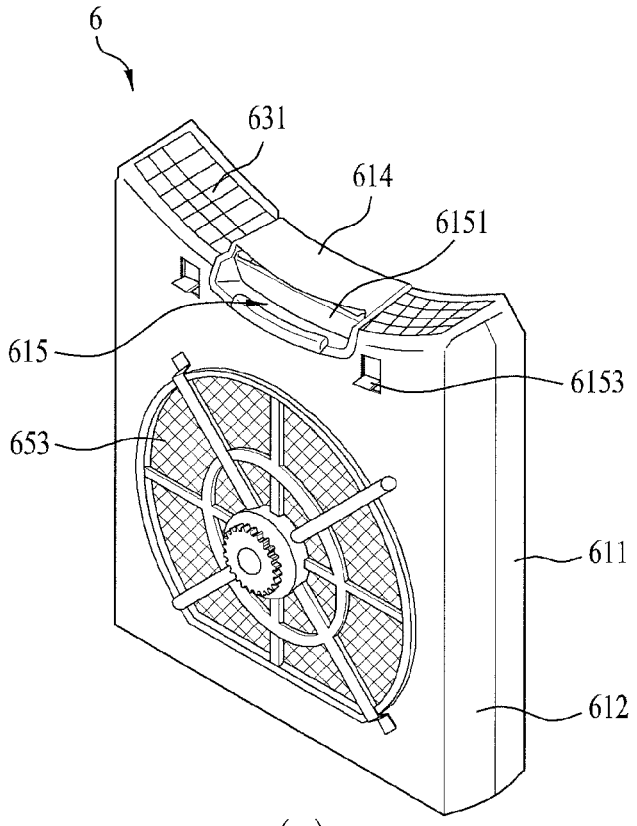
FIGS. 6A and 6B illustrate a structure of a housing fixing unit provided on the filter assembly.
Figure 6:
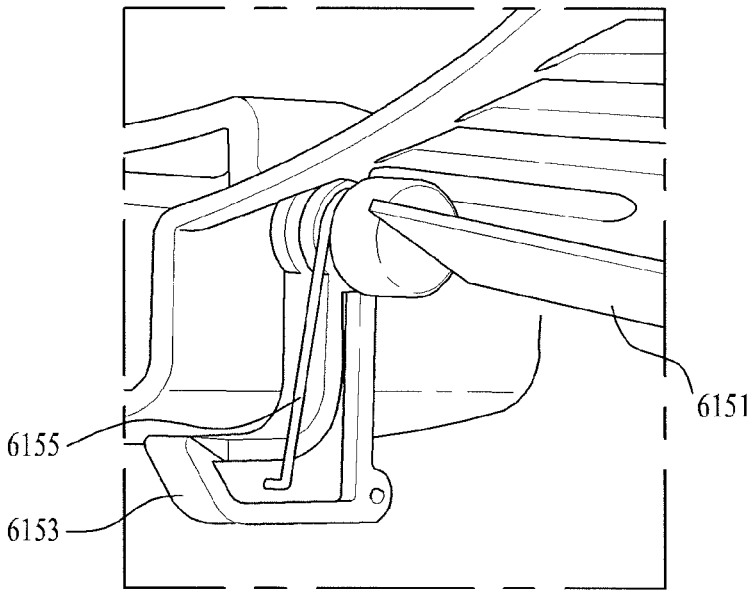

The filter assembly 6 may further include a housing fixing unit 615 to connect the filter assembly 6 to the suction hole 411 (see, for example, FIG. 6A).

As shown in FIG. 6A, the housing fixing unit 615 includes a lever 6151 located within the space provided by the handle 614 and hooks 6153 respectively provided at both opposite ends of the lever 6151.

In this case, hook grooves to receive the hooks 6153 or duct hooks to fix the hooks 6153 are preferably provided on the discharge duct 41.

The lever 6151 is hinged to the space provided by the handle 614 and is elastically supported by elastic members, such as springs 6155, as shown in FIG. 6B.

Therefore, when a user opens the door, rotates the lever 6151 to separate the hooks 6153 from the hook grooves provided on the discharge duct 41 and then lifts the housing 61 using the handle 614, the filter assembly 6 may be separated from the discharge duct 41.

Hereinafter, a detailed structure of the foreign substance removal unit 67 will be described with reference to FIGS. 7A and 7B and FIGS. 8A to 8C.

The foreign substance removal unit 67 may be configured such that the brush 671 is inserted into a slot provided at the center of the brush frame 673.

In this case, the brush 671 may have a length that is equal to or greater than a radius of the filter unit 65.

Further, the brush 671 may be formed of an elastic material, such as rubber, because the brush 671 removes foreign substances remaining on the filter units 65 while being rotated.

That is, if the brush 671 has high hardness, there is a possibility that the brush 671 damages the filter units 65, and if the brush 671 has low hardness, it may be more difficult to remove the foreign substance remaining on the filter units 65.

For this purpose, the brush 671 includes a plurality of recesses 6711 provided in the longitudinal direction of the brush 671.

The plurality of recesses 6711 locally reduces thickness of the brush 671, thus allowing the shape of the brush 671 to be deformed when the brush 671 contacts the filter units 65.

Therefore, the plurality of recesses 6711 facilitates a change of direction of the brush 671 when the foreign removal unit 67 is repeatedly rotated in the clockwise direction and in the counterclockwise direction (e.g., reciprocally rotated).

Figure 7:
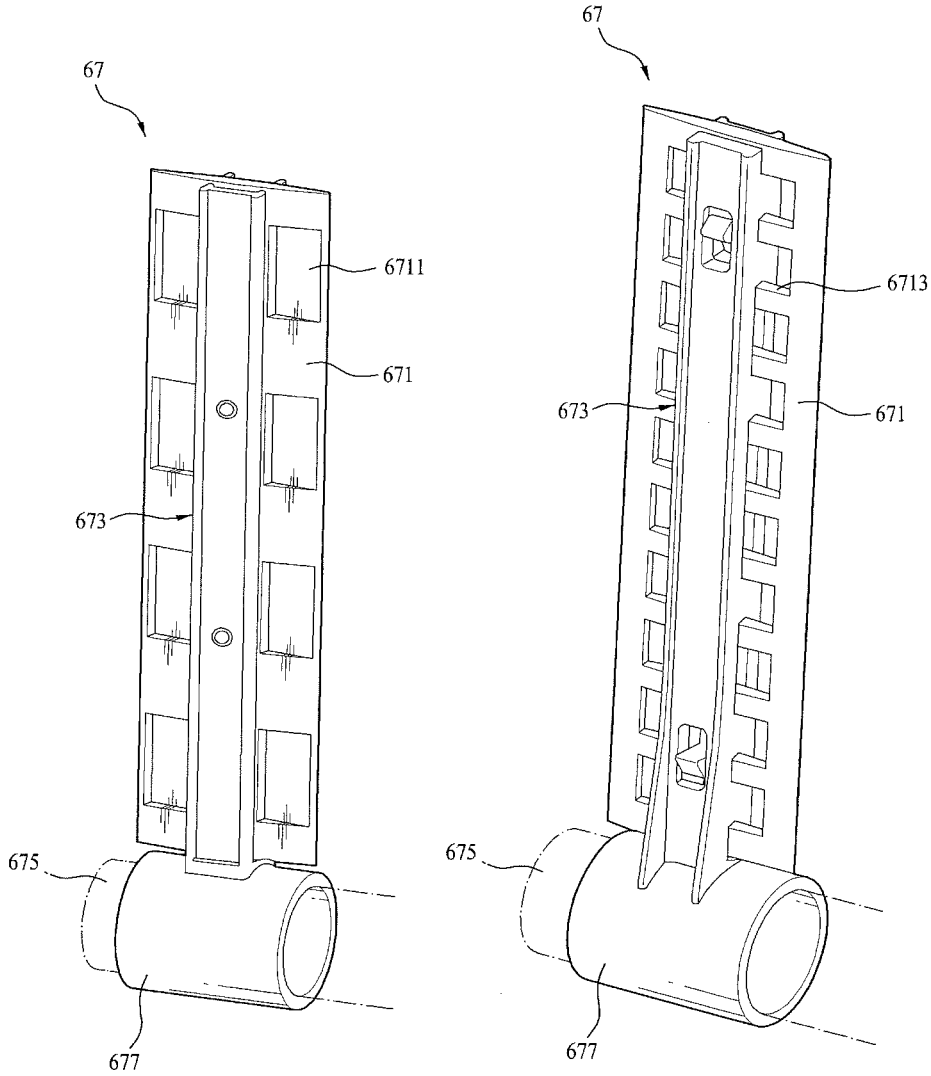
FIGS. 7A and 7B and FIGS. 8A to 8C illustrate various structures of the foreign substance removal unit.

Further, instead of the plurality of recesses 6711, a plurality of through holes 6713 may be provided, as shown in FIG. 7B.

Figure 8:
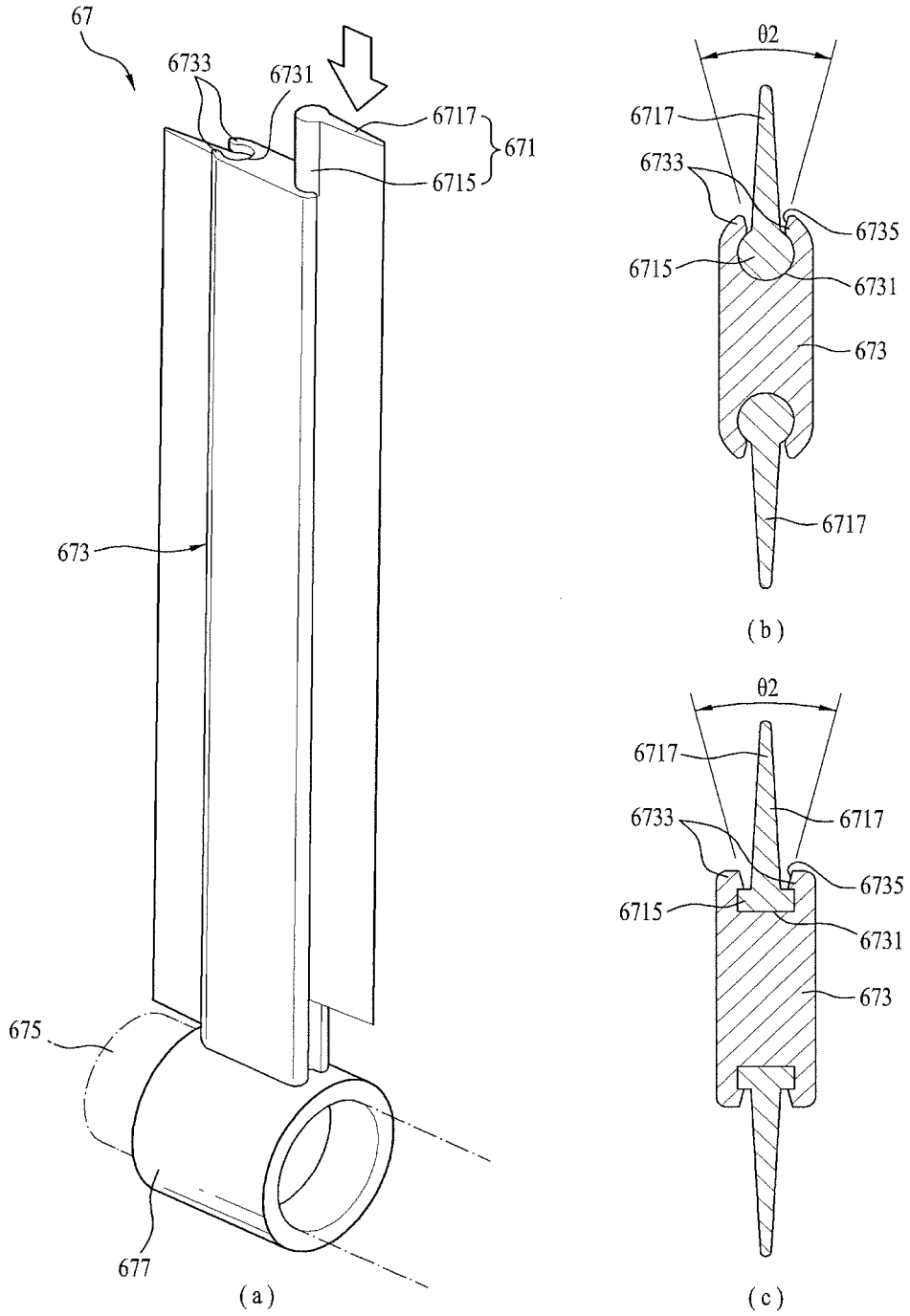

Structures of the foreign substance removal unit 67 shown in FIGS. 8A to 8C differ from the structures of the foreign substance removal unit 67 shown in FIGS. 7A and 7B in that slots 6731 are provided at both opposite ends of the brush frame 673 and the brush 671 includes insertion parts 6715 inserted into the slots 6731.

The foreign substance removal unit 67 is repeatedly rotated in the clockwise direction and in the counterclockwise direction within the housing. Therefore, if a contact angle between the brush 671 and the filter unit 65 is not changed when the rotating direction of the foreign substance removal unit 67 is changed, it may be difficult for the foreign substance removal unit 67 to remove the foreign substances remaining on the filter unit 65.

Such a problem may be solved by the brush 671 which is rotated with respect to the brush frame 673.

That is, if the brush 671 further includes contact parts 6717 extended from the insertion parts 6715 and exposed to the outside of the slots 6731 through openings of the slots 6731, the above issue may be addressed.

The slots 6731 may have various shaped cross-sections, e.g., may have a circular cross-section or a rectangular cross-section, as shown in FIGS. 8B and 8C. Here, the insertion parts 6715 of the brush 671 have a shape corresponding to the cross-sectional shape of the slots 6731.

Further, the brush frame 673 may include a pair of support parts 6733 extended from both opposite ends of each of the slots.

The support parts 6733 set a rotation range θ2 of the contact part 6717 of the brush 671, thereby restricting the brush 671 from being excessively rotated and thus from failing to remove the foreign substances remaining on the filter unit 65.

For this purpose, a distance between the support parts 6733 may be greater than a width of the contact part 6717, which will be described later, and an inclined surface 6735 at a designated angle may be provided at the end of each of the support parts 6733.

The brush 671 having the above-described structure is reciprocally rotated in the clockwise direction and in the counterclockwise direction within the angle range predetermined by the motor 7. Hereinafter, the reciprocal rotation angle range of the brush 671 will be described with reference to FIGS. 9A to 9D.

The brush 671 is reciprocally rotated in the housing by the motor 7 rotatable in the clockwise direction and in the counterclockwise direction, thereby moving the foreign substances remaining on the filter unit 65 to a storage space 69 located at the inside of the housing and then compressing the foreign substances.

The reciprocal rotation of the brush 671 serves to move the foreign substances remaining on the filter unit 65 including the first filter and the second filter to one side of the housing so as to reduce the remaining foreign substances in the filter unit 65.

The compression of the foreign substances in the storage space 69, provided in the housing, by the brush 671 serves to increase a frequency of operation of the clothes treating apparatus so as to reduce inconvenience in which a user frequently empties the filter assembly 6 even if a large amount of foreign substances are stored in the filter assembly 6.

In this case, the reciprocal rotation angle range A of the brush 671 may be set so as to have areas B overlapping with the storage space 69.

However, although the foreign substances are stored in a compressed state within the housing 61 of the filter assembly 6, the foreign substances shield a part of the filter unit 65 and thus the filtration capacity of the filter assembly 6 is inevitably lowered.

Therefore, a shape of the filter unit 65 to reduce the lowering of the filtration capacity of the filter assembly 6 even if foreign substances are stored in the filter assembly 6 will be described hereinafter.

Figure 9:
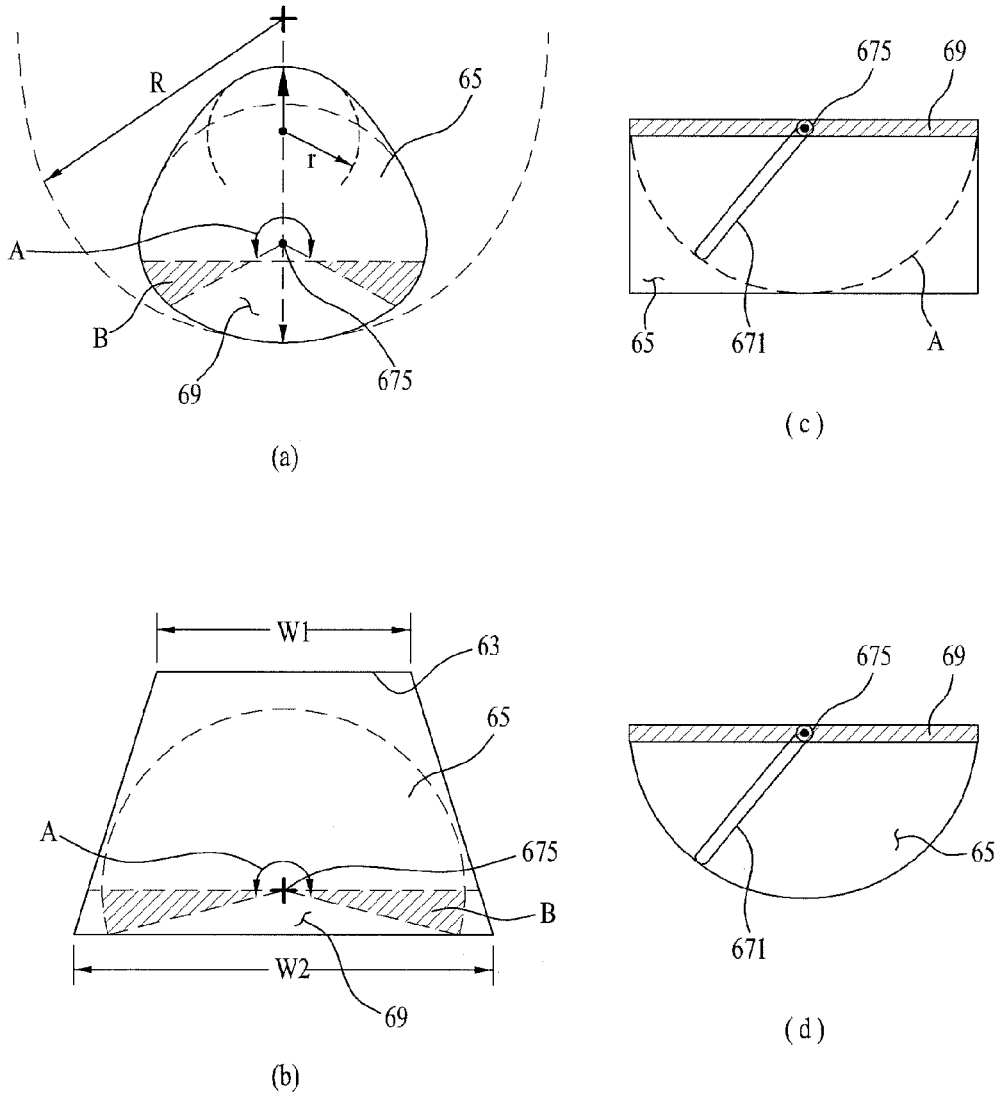
FIGS. 9A to 9D illustrate shapes and coverage area of a filter unit provided on the filter assembly.

The filter unit 65 may have a nonsymmetrical circular shape, as shown in FIG. 9A. That is, the filter unit 65 may be formed by connecting at least two circular arcs having different radiuses of curvature.

In this case, a radius R of curvature of a part of the filter unit 65 formed in the direction of stored foreign substances may be greater than a radius r of curvature of a part of the filter unit 65 formed in the direction of the inflow surface 63, and the brush 671 is rotatably provided within the circle formed by connecting the circular arc having the radius r of curvature and the circular arc having the radius R of curvature.

The circular arc having the radius r of curvature may be provided on the circular arc having the radius R of curvature, as shown in FIG. 9A, and the circular arc having the radius r of curvature may be provided under the circular arc having the radius R of curvature, which is different from that shown in FIG. 9A.

In some implementations, the storage space 69 is located within a space provided by the circular arc having the radius R of curvature. This causes the storage space 69 to be located within a space having a greater radius of curvature, thereby reducing a lowering of the filtration capacity of the filter assembly 6 even if foreign substances are located within the storage space 69.

Different from the above description, the filter unit 65 may be provided as a type in which a circular arc having the same radius r of curvature as the radius r of rotation of the brush 671 and a circular arc having a radius R of curvature smaller than the radius r of rotation of the brush 671 so as to reduce lowering of the filtration rate of the filter assembly.

Further, FIG. 9B illustrates the filter unit 65 having a polygonal shape provided with a plurality of sides.

In this case, the filter unit 65 may be configured such that a width w2 of a part of the filter unit 65 formed in areas B in which foreign substances are accumulated is greater than a width w1 of a part of the filter unit 65 provided with the inflow surface 63.

Since the brush 671 is reciprocally rotated by the brush rotating shaft 675, if the width of the filter unit 65 is increased in the direction from the inflow surface 63 to the storage space 69, lowering of the filtration capacity of the filter assembly 6 may be reduced although foreign substances are stored in the lower end of the filter unit 65.

FIG. 9C illustrates the filter unit 65 having a rectangular shape. Such a shape of the filter unit 65 is useful if the filter assembly 6 has the structure of FIG. 3.

In this case, the brush rotating shaft 675 may be provided at the center of one side of the filter unit 65, and the storage space 69 is located at the side of the filter unit 65 provided with the brush rotating shaft 675.

If the brush rotating shaft 675 is provided at the upper portion of the filter unit 65, as shown in FIG. 9C, the filter assembly may further include discharge holes 619 and a suction device connected to the discharge holes 619, as shown in FIG. 3, so as to discharge compressed foreign substances within the storage space 69 to the outside of the housing.

FIG. 9D illustrates the filter unit 65 having a semicircular shape. Here, a radius of the semicircular filter unit 65 is equal to or smaller than a length of the brush 671.

Control of the rotating direction of the motor 7 so as to reciprocally rotate the brush 671 within the predetermined angle range A may be achieved through a method using a sensor to sensing the position of the brush 671 and a control unit (not show) to receive a signal from the sensor and then to change the rotating direction of the motor, or a method using a motor to automatically change a rotating direction if resistance disturbing rotation of the brush 671 is sensed and stoppers. The latter example is described in the following section.

The motor 7 may be a synchronous motor which automatically changes the rotating direction of the motor rotating shaft 71 when resistance disturbing rotation of the brush 671 is sensed, and the stoppers may contact the brush 671 so as to restrict rotation of the brush 671 if the brush 671 is rotated in one direction by the predetermined angle.

Therefore, when the brush 671 is rotated in one direction out of the clockwise direction and the counterclockwise direction and contacts the stopper, the motor automatically changes a rotating direction thereof, thus rotating the brush 671 in the opposite direction.

FIGS. 10A and 10B and FIGS. 11A and 11B illustrate stoppers in accordance with implementations of the present disclosure. In the following, the stoppers are described in greater detail.

Stoppers 616 may be a pair of protrusions provided in the housing 61 and separated from each other by the same angle as the rotation angle range of the brush 671.

Figure 10:
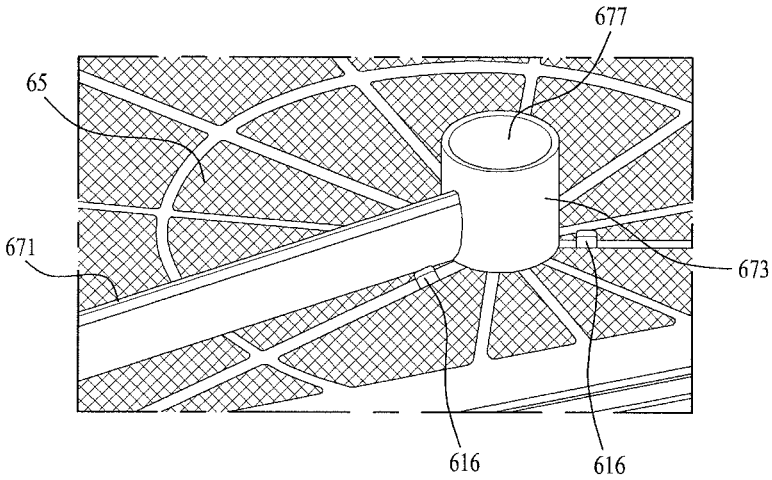
FIGS. 10A and 10B and FIGS. 11A and 11B illustrate stoppers to restrict a rotation range of the foreign substance removal unit.
Figure 10:
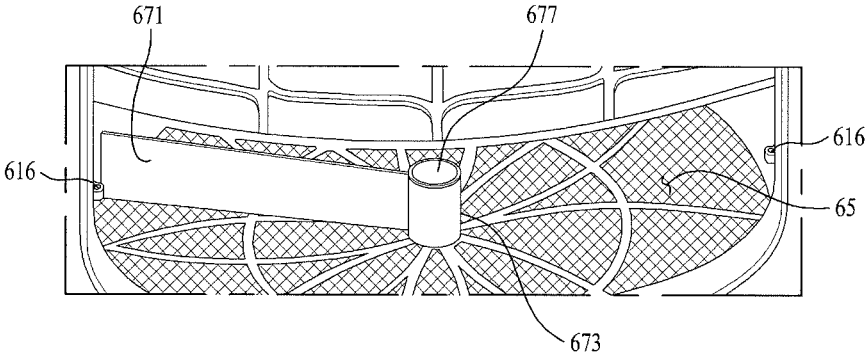

In this case, the stoppers 616 may be provided at the inside of a filtration area of the filter unit 65, as shown in FIG. 10A, or be provided at the outside of the filtration area of the filter unit 65, as shown in FIG. 10B.

FIGS. 11A and 11B illustrate one stopper 6551 provided on the filter unit 65. In this case, a stopper receipt groove 6737 to receive the stopper 6551 is provided on the brush frame 673.

Figure 11:
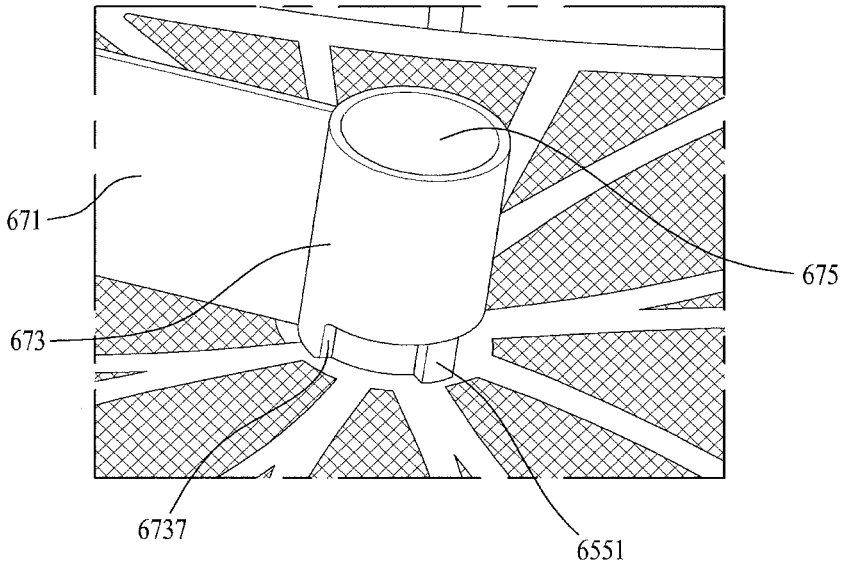
Figure 11:
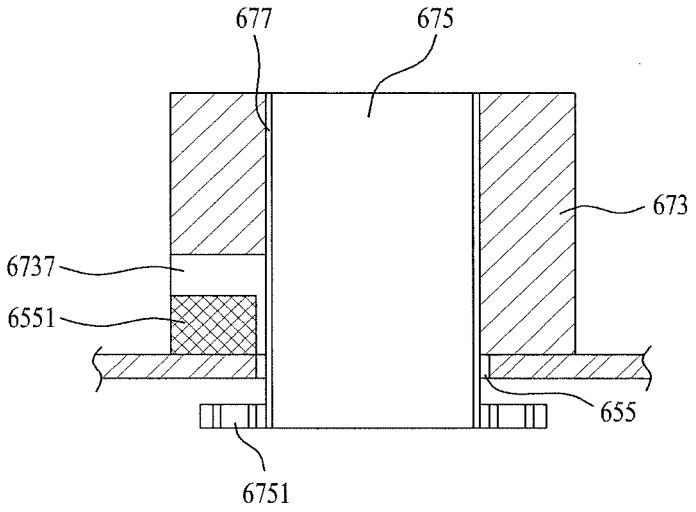

That is, the stopper 6551 shown in FIG. 11 is protruded from the outer circumferential surface of a shaft passing hole 655 provided on the filter unit 65 such that the brush rotating shaft 675 passes through the shaft passing hole 655, and the stopper receipt groove 6737 is bent on the brush frame 673.

In this case, a width of the stopper receipt groove 6737 may be set to cause the stopper 6551 to contact the stopper receipt groove 6737 when the brush frame 673 is rotated by the predetermined angle.

The clothes treating apparatus having the above-described configuration filters out foreign substances, such as lint, generated during a drying process of clothes and discharges foreign substances remaining on the filter unit to the outside of the filter assembly, thereby reducing a decrease in the drying efficiency.

Further, the clothes treating apparatus compresses the foreign substances and then stores the compressed foreign substances in the storage space, thereby reducing a frequency of cleaning of the filter assembly.

However, the clothes treating apparatus in accordance with the present disclosure requires that a user periodically removes foreign substances stored in the filter assembly. Therefore, a sensing unit to determine whether or not an amount of foreign substances stored in the filter assembly exceeds an amount of acceptable foreign substances (e.g., a predetermined reference storage amount) will be described hereinafter.

The sensing unit may be an angle detection unit to sense a rotation angle range of the brush 671. In this case, the cabinet 1 may include a display unit 11 (with reference to FIG. 1) to inform a user that the amount of collected foreign substances exceeds the reference storage amount based on a signal supplied from the sensing unit.

When the amount of the foreign substances stored in the filter assembly exceeds the reference storage amount, the brush 671 is reciprocally rotated within an angle range smaller than the predetermined angle range.

Therefore, if the angle detection unit is provided so as to sense whether or not the brush 671 is rotated within the angle range smaller than the predetermined angle range in a regular direction or the reverse direction, the sensing unit may determine discharge time of the foreign substances stored in the filter assembly.

The angle detection unit may include at least one contact sensor provided at the same position as the position of the stopper(s) 616 or 6551, or two contact sensors having an angle range smaller than the set reciprocal rotation angle range of the brush 671.

In an alternative implementation, the filter assembly may include at least one weight sensor to weigh the amount of foreign substances that are collected. The weight sensor may trigger an alert to inform a user, using the display unit 11, that the amount of collected foreign substances exceeds a reference weight based on a weight of the collected foreign substance sensed by the weight sensor. In yet another alternative implementation, the filter assembly may include at least one infra-red (IR) sensor that intercepts an IR beam produced by an IR beam generating unit. If the amount of collected foreign substances exceeds the reference storage amount, then the IR sensor may not be able to intercept (e.g., "sense") the IR beam and therefore trigger an alert to indicate to a user that the amount of collected foreign substances exceeds the reference storage amount.

The display unit 11 may be provided as a panel (an LCD panel or an LED panel) to display a message of emptying the filter assembly in which foreign substances are stored to a user, or be provided as a speaker to provide an alarm.

Figure 12:
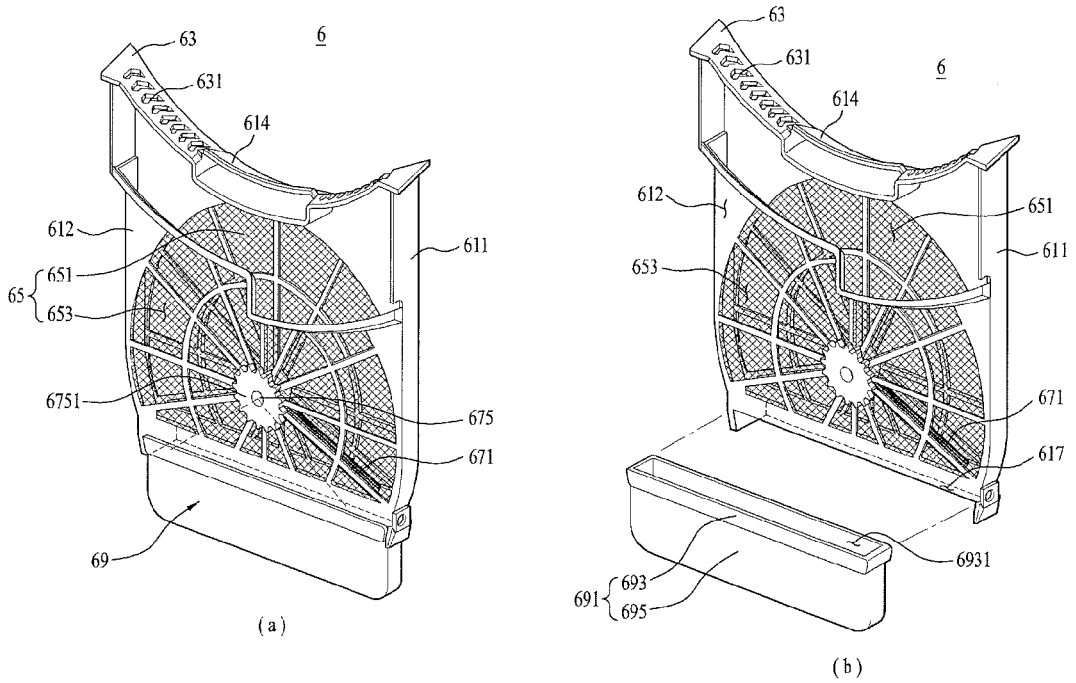
FIGS. 12A and 12B illustrate a filter assembly 6 in accordance with another implementation of the present disclosure.

FIGS. 12A and 12B illustrate a filter assembly 6 in accordance with another implementation of the present disclosure. The filter assembly 6 in accordance with this implementation is characterized in that the storage space 69 is provided as a collection unit 691 attached to and detached from the housing 61.

In this case, positional relations among the filter assembly 6, the storage space 69 and the discharge duct 41 are shown in FIG. 22 or 23.

The filter assembly 6 in accordance with this implementation further includes a communication hole 617 provided at the lower portion of the housing 61 to discharge foreign substances to the collection unit 691.

The collection unit 691 includes a connection part 693 connected to the lower portion of the housing 61 and a storage part 695 fixed to the connection part 693 to store the foreign substances.

The connection part 693 may be provided with an opening 6931 communicating with the connection hole 617 and the storage part 695.

The connection part 693 may have various structures causing the collection unit 691 to be attached to and detached from the housing 61, e.g., a pair of female and male slots or a set of hook and hook groove.

Therefore, in order to remove foreign substances stored in the collection unit 691, a user separates the filter assembly 6 from the discharge duct 41, separates the collection unit 691 from the housing 61, and then washes the storage part 695.

The storage part 695 may be formed of various materials in various shapes as long as the storage part 695 may store foreign substances discharged through the communication hole 617.

If the storage part 695 is provided as a mesh shape, the storage part 695 may function as a third filter.

That is, air introduced into the housing 61 may be supplied to the inside of the duct unit 4 through the storage part 695 of the collection unit 691 as well as the filter unit 65, and thus the mesh-shaped storage part 695 may perform the function of the filter.

Figure 13:
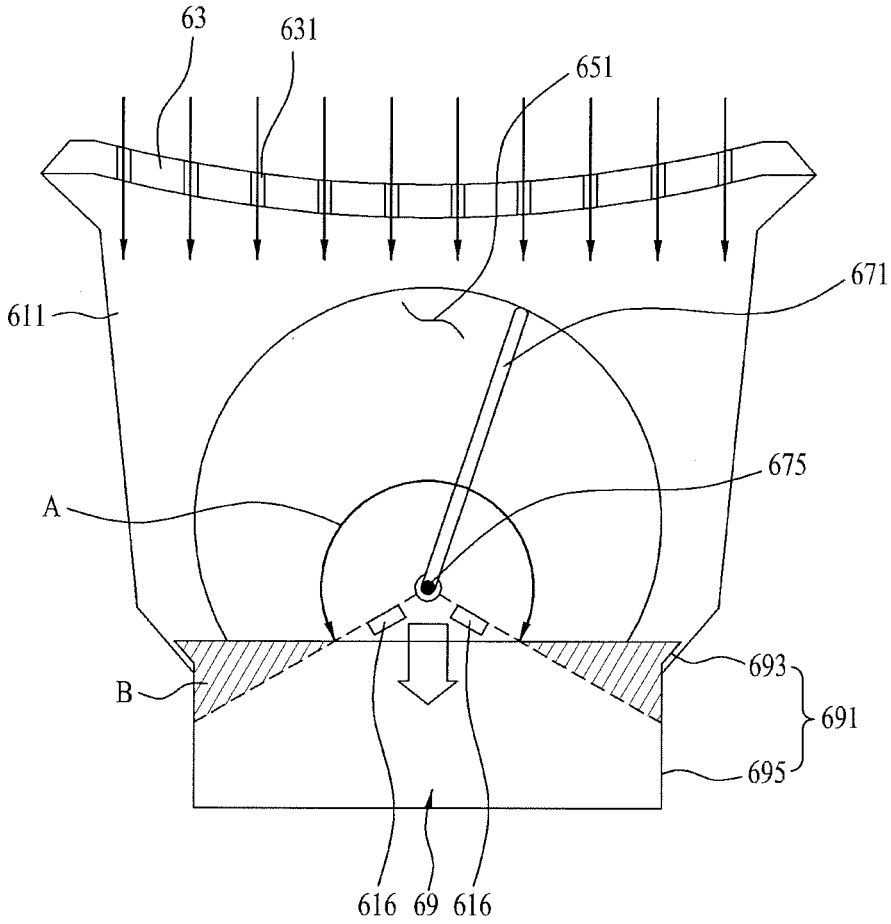
FIG. 13 illustrates compression of foreign substances in the filter assembly shown in FIGS. 12A and 12B.

As shown in FIG. 13, in the filter assembly 6 in accordance with this implementation, the rotation area A of the brush 671 may be set to overlap with the storage area provided by the collection unit 691 so as to form overlapping areas B.

When the brush 671 is rotated in one direction (for example, the counterclockwise direction), foreign substances remaining on the filter unit 65 move to the collection unit 691 through the communication hole 617.

Here, the motor 7 rotates the brush rotating shaft 675 until the free end of the brush 671 (e.g., one end of the brush 671 into which the brush rotating shaft 675 is not inserted) is received in the collection unit 691, and then causes the brush 671 to be rotated in the clockwise direction when the free end of the brush 671 is received in the collection unit 691.

Change of the rotating direction of the brush 671 when the free end of the brush 671 is received in the collection unit 691 serves to compress the foreign substances stored in the storage part 695.

Therefore, although the frequency of operation of the clothes treating apparatus is increased and thus a large amount of foreign substances are stored in the storage part 695, the brush 671 compresses the foreign substances and thus the filter assembly 6 in accordance with the present disclosure may reduce the volume of the foreign substance stored in the collection unit 691.

The configuration and method of reciprocally rotating the brush 671 within the predetermined angle range are described above, and thus a detailed description thereof is not repeated.

Figure 14:
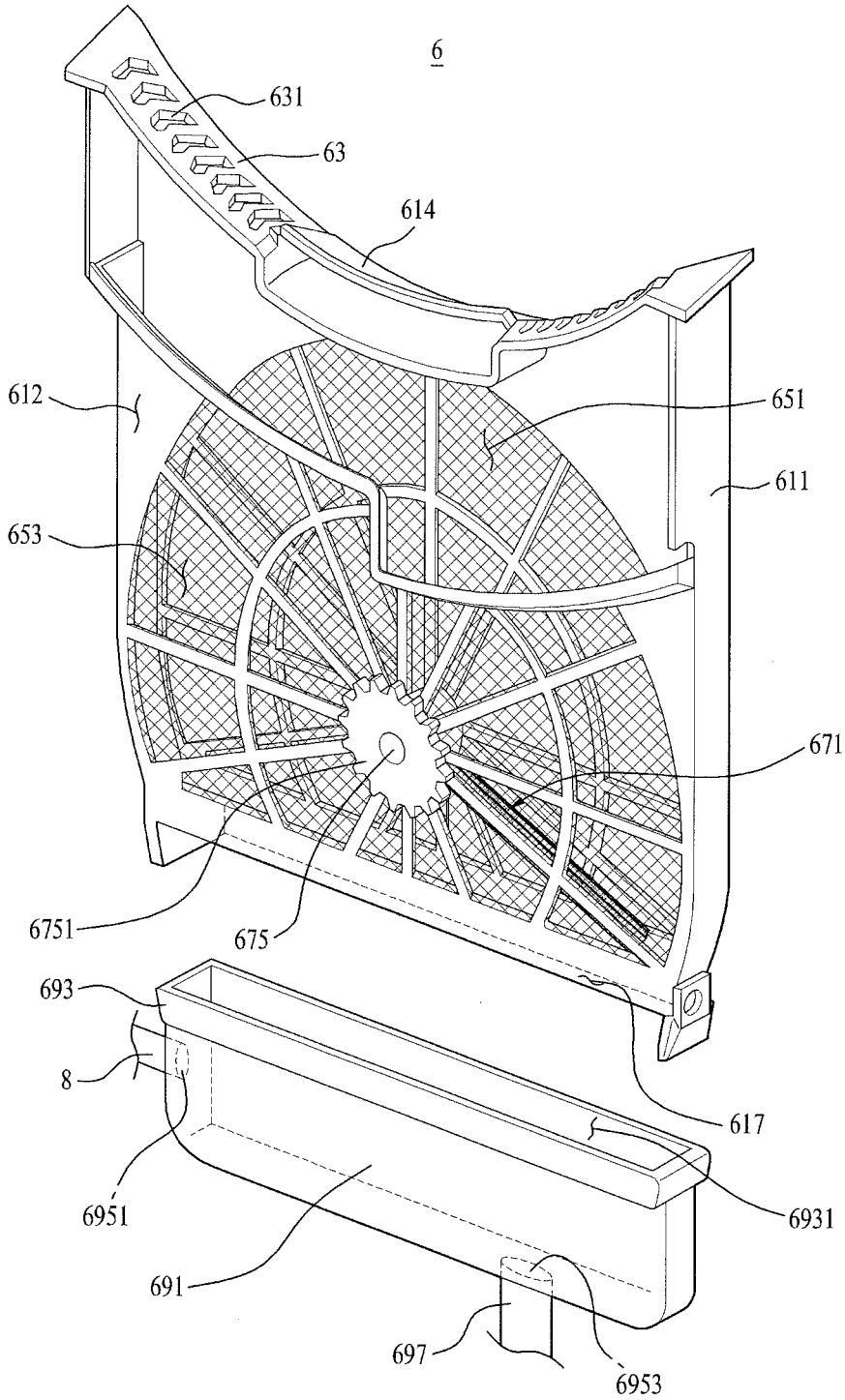
FIG. 14 and FIGS. 15A to 15E illustrate examples of filter assemblies, each of which includes a storage space in accordance with implementations of the present disclosure.

FIG. 14 illustrates a structure of a filter assembly to automatically discharge foreign substances stored in a collection unit in accordance with another implementation of the present disclosure. The collection unit 691 in accordance with this implementation includes an introduction hole 6951 communicating with the outside and a discharge hole 6953.

A fluid supply unit 8 to supply a fluid, such as air or water, is connected to the introduction hole 6951, and a discharge hose 697 through which foreign substances in the collection unit 691 together with the fluid are discharged to the outside is connected to the discharge hole 6953.

Although the introduction hole 6951 and the discharge hole 6953 provided on the collection unit 691 will be described hereinafter, in case of the filter assembly (with reference to FIG. 2) in which storage space is provided within the housing, the introduction hole and the discharge hole may be provided on the housing of the filter assembly.

Figure 15A:
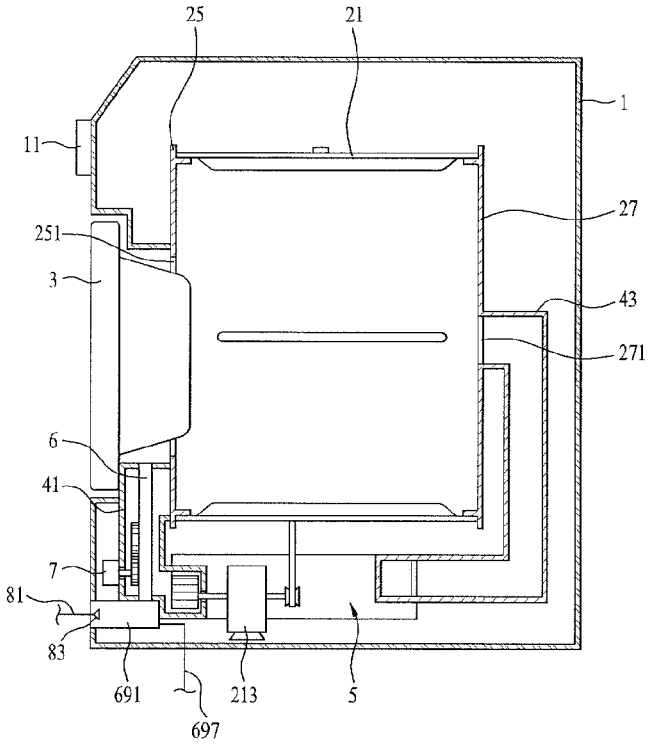

FIGS. 15A to 15E illustrate cases in which wash water is supplied to the collection unit 691 through the fluid supply unit 8. Particularly, FIG. 15A illustrates a case in which the introduction hole 6951 is connected to a water supply source provided at the outside of the clothes treating apparatus through a supply hose 81.

In this case, the collection unit 691 detachably provided on the communication hole 617 of the housing 61 may be located at the discharge duct 41.

Therefore, a hole communicating the opening 6931 of the collection unit 691 with the communication hole 617 of the housing 61 may be provided in the discharging duct 41.

Further, a nozzle 83 may be provided at the end of the supply hose 81 so as to effectively remove the foreign substances in the collection unit 691. Moreover, the bottom surface of the collection unit 691 may be inclined toward the discharge hose 697.

Figure 15B:
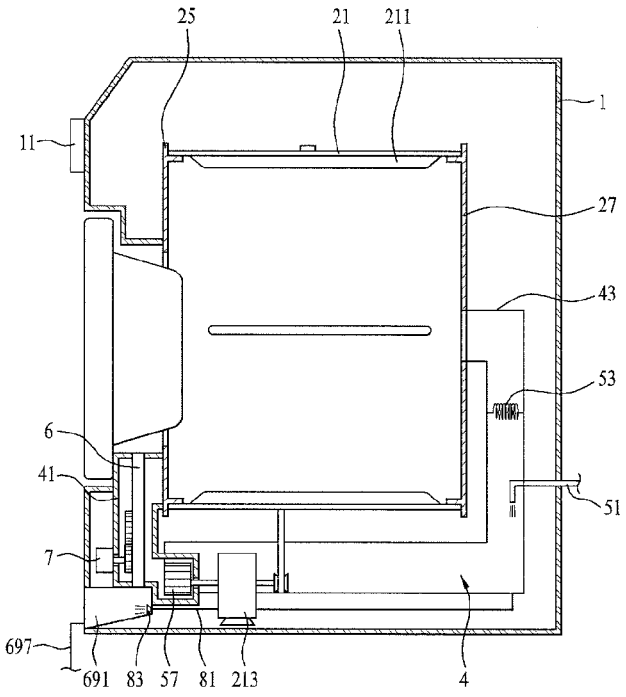
Figure 15C:
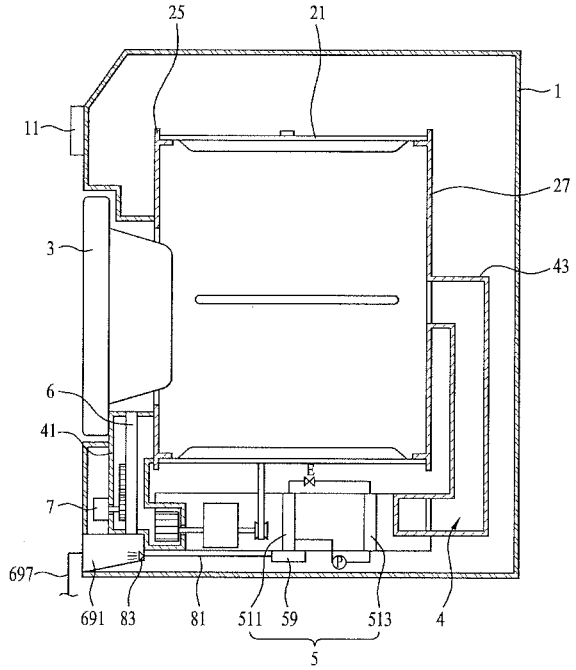

FIGS. 15B and 15C respectively illustrate structures in which wash water is supplied to the inside of the collection unit using a condensing part provided on a circulation type clothes treating apparatus.

A circulation type clothes treating apparatus of FIG. 15B includes a heating part 57 and a condensing part 51 to spray condensation water, supplied from a water supply source provided at the outside of the clothes treating apparatus, to the inside of the duct unit 4.

Therefore, if the supply hose 81 is provided so as to supply condensation water, sprayed from the condensing part 51 and discharged to the outside of the duct unit 4, to the collection unit 69, an effect in which the condensation water allows foreign substances within the collection unit 69 to be discharged to the outside may be achieved.

FIG. 15C illustrates a circulation type clothes treating apparatus provided with a heat pump as the air supply unit 5.

The heat pump 5 is a heat exchange device in which an evaporator 511, a compressor P, a condenser 513, and an expander E are connected through a refrigerant circulation channel.

The evaporator 511 absorbs heat from air introduced into the duct unit 4 and evaporates a refrigerant, thus removing moisture from air contacting the evaporator 511. Further, the condenser 513 discharges latent heat generated from a condensing process of the refrigerant to the inside of the duct unit 4, thus heating air contacting the condenser 513. Therefore, if the heat pump is provided as the air supply unit 5, the evaporator 511 serves as a condensing part and the condenser 513 serves as a heating part.

In this case, since air flowing within the duct unit 4 is condensed through heat exchange with the evaporator 511, the evaporator 511 generates condensation water.

Therefore, if a sump 59 to collect the condensation water is provided at the lower portion of the evaporator 511 and the supply hose 81 is provided so as to connect the sump 59 to the collection unit 691, washing of the collection unit 691 using the condensation water is possible.

Figure 15D:
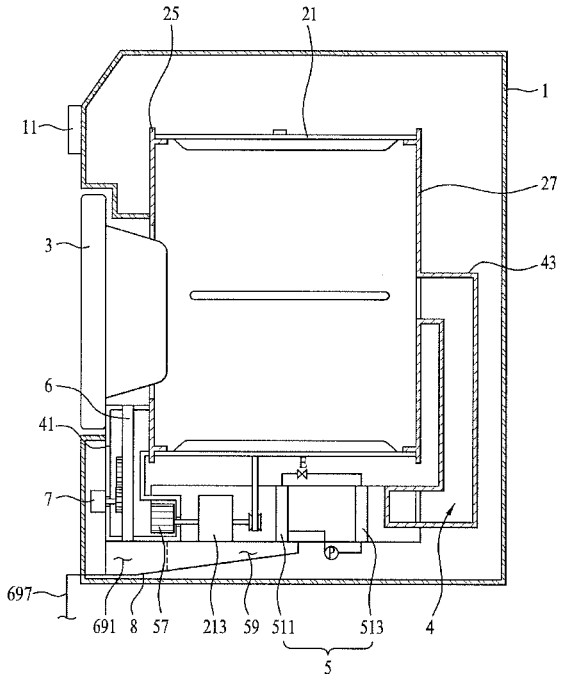

FIG. 15D illustrates a filter assembly 6 in accordance with another implementation of the present disclosure in which a collection unit 691 and a sump 59 are provided within one basket and the basket serves as a fluid supply unit 8.

In this case, the bottom surface of the basket may be inclined so that condensation water collected in the sump 59 may flow toward the collection unit 691.

Figure 15E:
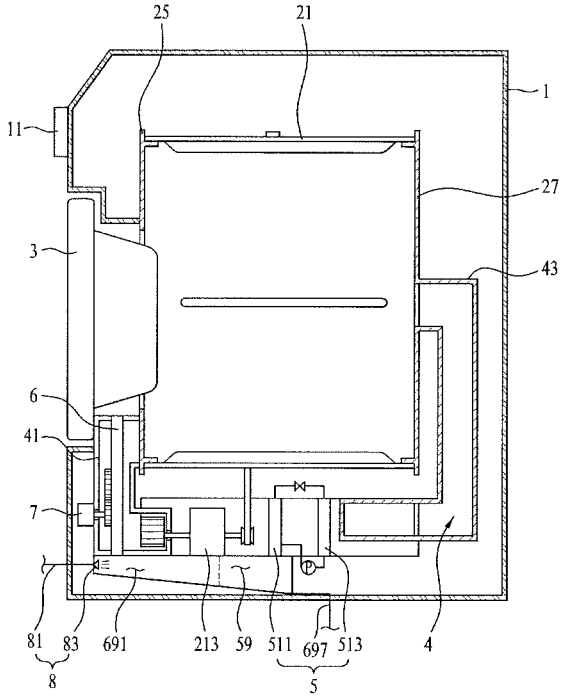

FIG. 15E illustrates a filter assembly 6 in accordance with another implementation of the present disclosure in which a basket is inclined toward a sump 59. In this case, the fluid supply unit 8 includes a supply hose 81 to supply wash water supplied from an external water supply source to the inside of the basket, and a nozzle 83 is provided on the supply hose 81.

Figure 16:
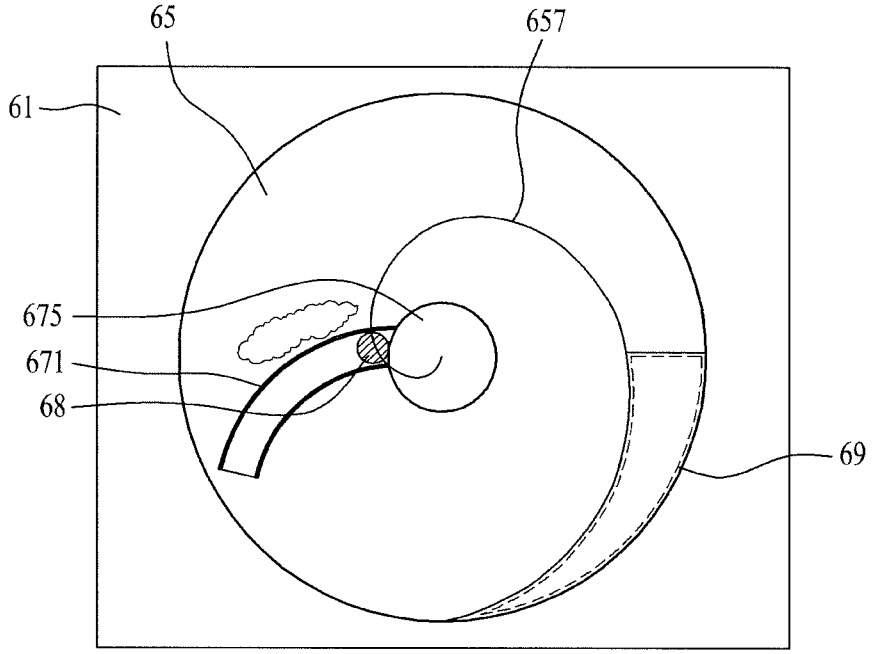
FIG. 16 and FIGS. 17A to 17C illustrate a filter assembly in accordance with another implementation of the present disclosure.

FIG. 16 illustrates a filter assembly 6 in accordance with another implementation of the present disclosure.

The filter assembly 6 in accordance with this implementation is characterized in that foreign substances within the storage space 69 are compressed when the brush 671 is rotated in a specific direction and a spiral foreign substance guider 657 is provided in the outer circumferential direction of the filter unit 65 from the center of the filter unit 65.

If the brush 671 is not formed at the center of the filter unit 65, the foreign substance guider 657 may be spirally provided in the outer circumferential direction of the filter unit 65 from the brush rotating shaft 675.

In the filter assembly 6 having the above-described configuration, when the brush 671 is rotated, foreign substances remaining on the filter unit 65 are moved to the storage space 69 under guidance of the foreign substance guider 657. In this case, the foreign substance guider 657 has a spiral structure, the width of which is decreased in the direction closer to the outer circumferential surface of the filter unit 65, and thus the foreign substances are compressed and stored in an area (e.g., the storage space 69) in which the outer circumferential surface of the filter unit 65 and the foreign substance guider 657 contact (with reference to FIGS. 17(*a*) to 17(*c*)).

The filter assembly 6 in accordance with this implementation may further include a brush guider 68 to rotate the brush 671 under guidance of the foreign substance guider 657. The brush guider 68 serves to allow the brush 671 to go through the storage space 69 during rotation of the brush 671.

The brush guider 68 may be provided as various shapes as long as the brush guider 68 may perform the above-described function, and a detailed description thereof is not repeated.

Figure 17:
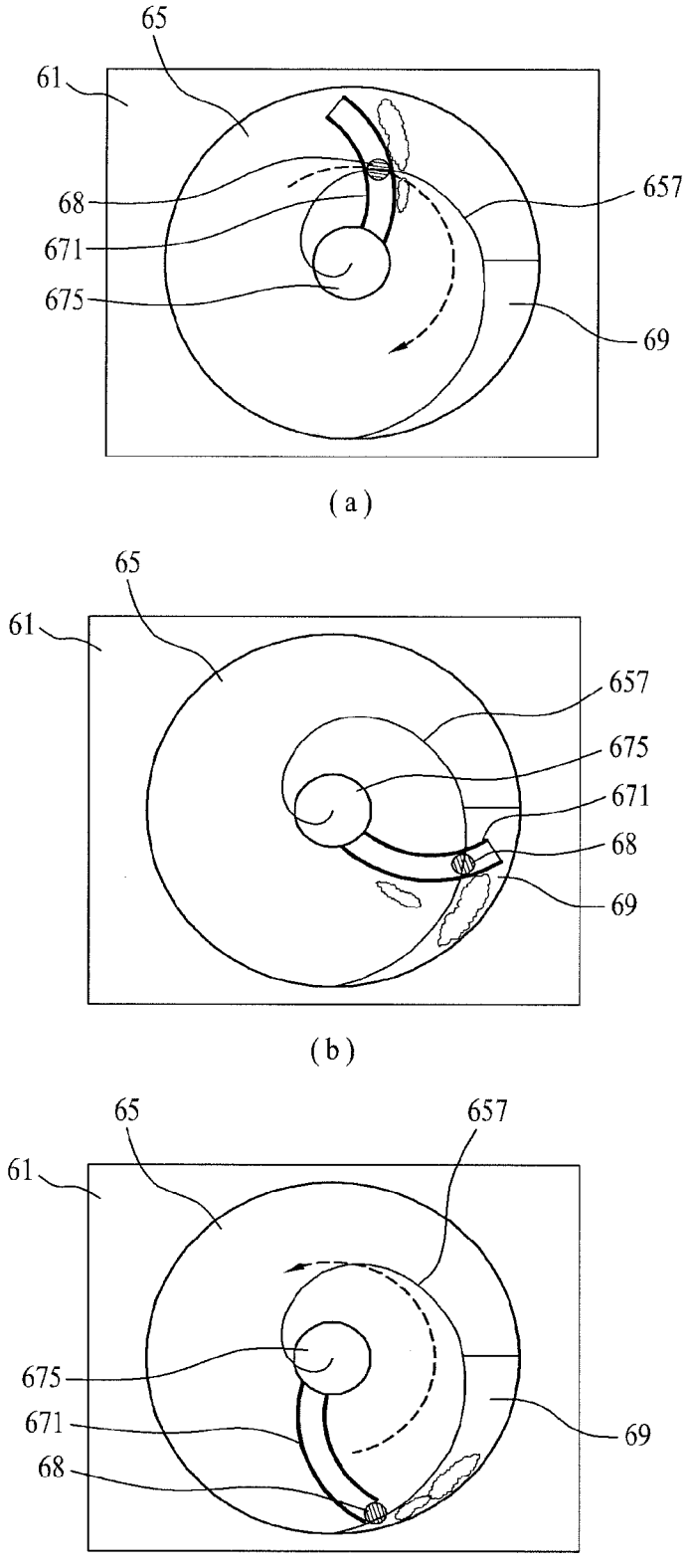

Although FIG. 16 and FIGS. 17(*a*) to 17(*c*) illustrate the brush having a curved shape, a brush having a straight shape may be provided.

Figure 18:
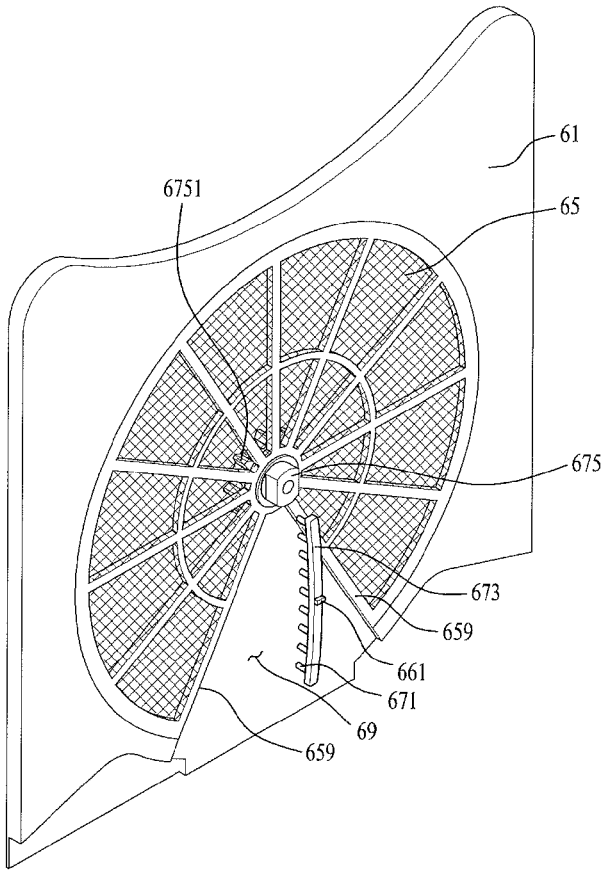
FIG. 18, FIG. 19 and FIGS. 20A to 20C illustrate a filter assembly in accordance with another implementation of the present disclosure.

FIG. 18 illustrates a filter assembly in accordance with another implementation of the present disclosure. The filter assembly in accordance with this implementation includes a brush frame 673 rotatably provided on a filter unit 65, a brush 671 provided on the brush frame 673, and a pair of protrusions 659 protruded from the center of rotation of the brush frame 673 in the outer circumferential direction of the filter unit 65.

In this case, a space provided between the pair of protrusions 659 becomes a storage space 69.

The protrusions 659 are protruded from the surface of the filter unit 65, and the brush 671 has a length to contact with the surface of the filter unit 65. Therefore, when the brush frame 673 is rotated, foreign substances in the filter unit 65 are moved toward the protrusions 659 by the brush 671, and the brush 671 compresses the foreign substances while passing through the protrusions 659 and then moves the compressed foreign substances to the storage space 69.

The storage space 69 may have a depth that is sufficient to restrict the brush 671 from contacting the storage space 69. Such a depth of the storage space 69 serves to allow the foreign substances moved to the storage space 69 to be separated from the brush 671 and then to be stored within the storage space 69.

Figure 19:
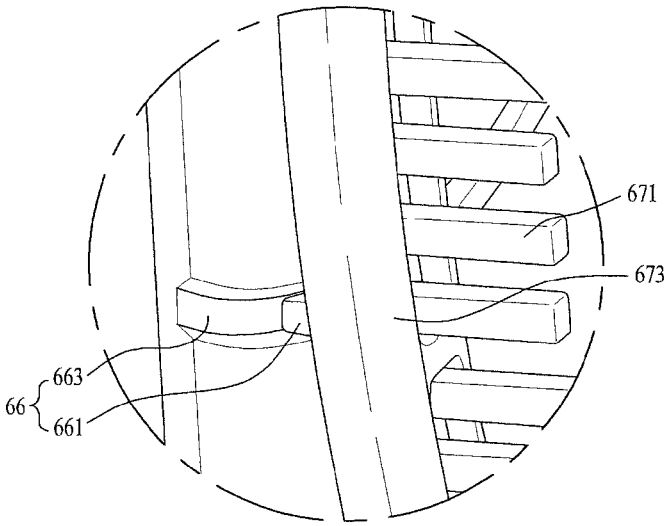

The filter assembly in accordance with this implementation may further include a pressing unit 66 (see, for example, FIG. 19) to supply pressure to the brush frame 673 so as to maintain contact of the brush 671 with the filter unit 65.

The pressing unit 66 includes a pressing protrusion 661 protruded from the brush frame 673 and a protrusion receipt groove 663 to receive the pressing protrusion 661.

If the filter assembly has a structure in which a first housing part and a second housing part are folded, the brush frame 673 may be provided on the first housing part and the protrusion receipt groove 663 may be provided on the second housing part.

Figure 20:
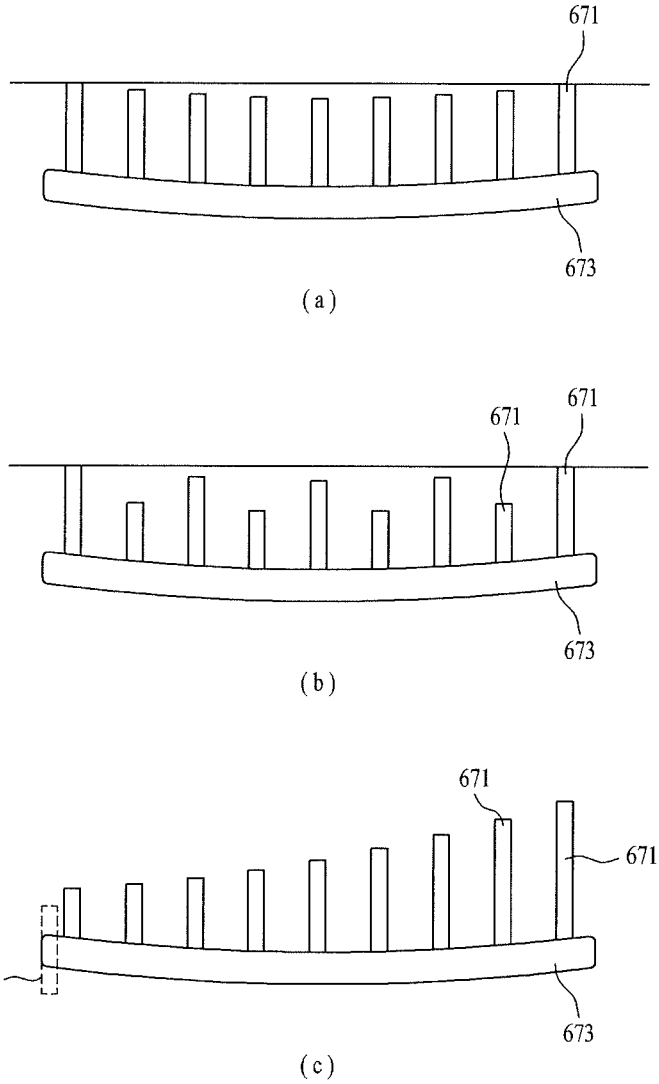

Lengths of bristles of the brush 671 provided on the brush frame 673 may be the same along the brush frame 673 (e.g., having a streamlined shape), as shown in FIG. 20A, be irregular, as shown in FIG. 20B, or be gradually increased or decreased as the bristles of the brush 671 are distant away from the brush rotating shaft 675, as shown in FIG. 20C.

When the lengths of the bristles of the brush 671 are regular, the brush 671 contacts the surface of the filter unit 65 at a regular pressure and thus thoroughly removes foreign substances remaining on the filter unit 65, but a wear amount of the brush 671 increases and a load of the motor increases. Therefore, if the bristles of the brush 671 have irregular lengths, reduction of the wear amount of the brush 671 and the reduction of the load of the motor may be expected.

Since components, such as the driven gear and the motor, are located around the brush rotating shaft 675, a larger amount of foreign substances may be collected in the edge of the filter unit 65 than in the center of the filter unit 65. Therefore, if the bristles of the brush 671 have lengths which are gradually increased or decreased as the bristles of the brush 671 are distant away from the brush rotating shaft 675, an area on which the foreign substances are locally concentrated may be effectively cleaned.

Figure 21:
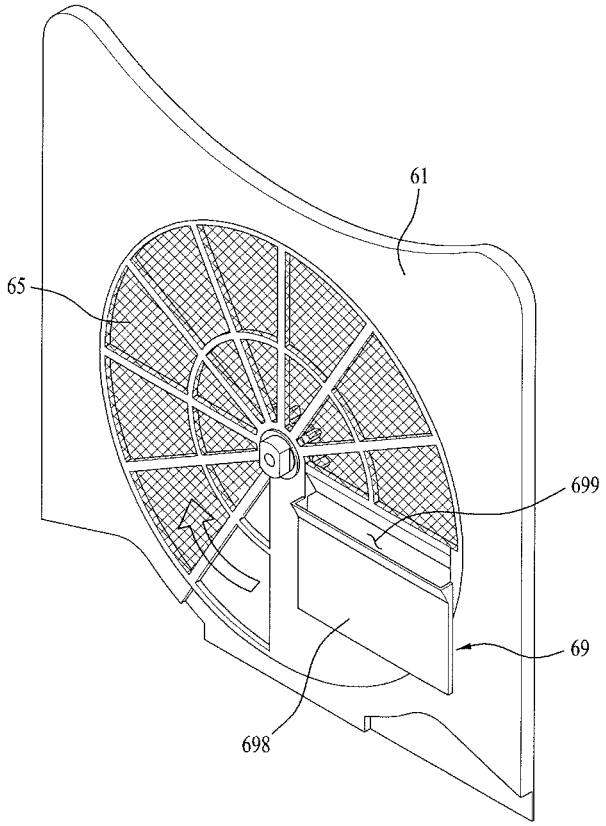
FIG. 21 illustrates a filter assembly in accordance with a further implementation of the present disclosure.

FIG. 21 illustrates a filter assembly in accordance with another implementation of the present disclosure characterized in that a storage space 69 provided in a housing 61 includes a foreign substance inflow hole 699 and a collection unit 698.

That is, the storage space 69 in accordance with this implementation includes the collection unit 698 located within an inner space formed by a first housing part and the second housing part and the foreign substance inflow hole 699 to guide foreign substances removed from a rotating brush to the collection unit 698.

As apparent from the above description, the present disclosure provides a clothes treating apparatus with a filter assembly which removes foreign substances from air discharged from a clothes accommodating space.

Further, the present disclosure provides a clothes treating apparatus with a filter assembly in which filter units to remove foreign substances is automatically cleaned.

Further, the present disclosure provides a clothes treating apparatus with a filter assembly in which foreign substances removed by filter units are compressed and then stored.

Moreover, the present disclosure provides a clothes treating apparatus in which a storage space to store foreign substance is automatically washed.

It will be apparent to those skilled in the art that various modifications and variations can be made in the present disclosure without departing from the spirit or scope of the implementations. Thus, it is intended that the present disclosure covers the modifications and variations provided they come within the scope of the appended claims and their equivalents.

What is claimed is:

1. A clothes treating apparatus comprising:

an accommodating space configured to receive one or more clothing articles;

an air supply unit configured to supply air to the accommodating space;

a duct unit configured to guide discharge of air from the accommodating space; and a filter assembly positioned to filter air discharged from the accommodating space through the duct unit, the filter assembly comprising:

a housing;

a filter positioned in the housing and configured to filter substances from air passing through the filter assembly; and a substance removal unit configured to move substances remaining on a portion of the filter and press substances moved from the filter into a storage space defined within the housing, the storage space being configured to collect removed substances within the housing, wherein the substance removal unit includes a brush within the housing, the brush configured to:

rotate back and forth over an angle range that covers less than all of the filter;

brush substances remaining on the filter toward the storage space defined within the housing, the storage space being located at a portion of the housing outside of the angle range through which the brush rotates; and compress substances into the storage space as substances brushed from the filter fill the storage space and expand into the angle range through which the brush rotates.

2. The clothes treating apparatus of claim 1:

wherein the storage space includes an overlapping portion that overlaps with the portion of the filter from which substances are moved from the filter by the substance removal unit, the overlapping portion being less than all of the storage space;

wherein the storage space includes a non-overlapping portion that does not overlap with the portion of the filter from which substances are moved from the filter by the substance removal unit, the non-overlapping portion being less than all of the storage space; and wherein the substance removal unit is configured to compress substances collected in the storage space by pressing substances in the overlapping portion of the storage space toward the non-overlapping portion of the storage space.

3. The clothes treating apparatus of claim 1, wherein the angle range is set such that a rotation area of the substance removal unit overlaps with a section of the storage space.

4. The clothes treating apparatus of claim 3, wherein the substance removal unit is configured to rotate back and forth over the angle range such that the substance removal unit presses substances moved from the filter into a first side of the storage space when rotating in a clockwise direction and presses substances moved from the filter into a second side of the storage space when rotating in a counterclockwise direction.

5. The clothes treating apparatus of claim 1, wherein the filter is a first filter unit and the filter assembly comprises a second filter unit configured to filter substances from air passing through the filter assembly.

6. The clothes treating apparatus of claim 5, wherein the substance removal unit is positioned between the first filter unit and the second filter unit when the first filter unit and the second filter unit are assembled in the filter assembly, and the substance removal unit is configured to move substances remaining on the first filter unit and the second filter unit and press substances moved from the first filter unit and the second filter unit into the storage space defined within the housing.

7. The clothes treating apparatus of claim 5, wherein:

the first filter unit or the second filter unit is formed in a shape in which at least two circular arcs having different radiuses of curvature are connected; and the storage space is located at a portion of the filter assembly having a largest radius of curvature.

8. The clothes treating apparatus of claim 5, wherein:

the first filter unit and the second filter unit are each rectangular in shape; and the substance removal unit is coupled to each filter unit at a center of one side of each filter unit.

9. The clothes treating apparatus of claim 5, wherein:

the first filter unit and the second filter unit are each semicircular in shape; and the substance removal unit is coupled to each filter unit at a diametric center of each filter unit.

10. The clothes treating apparatus of claim 1, wherein:

the housing includes a discharge hole through which the substances located in the storage space are discharged to the outside of the housing.

11. The clothes treating apparatus of claim 1, wherein:

the duct unit includes a suction hole into which air discharged from the accommodating space is introduced; and the housing is coupled to the duct unit through the suction hole, and includes an inflow surface that is connected to the suction hole and through which air is introduced into the housing.

12. The clothes treating apparatus of claim 5, wherein:

the housing includes a first housing part provided with an inflow surface that is connected to a suction hole into which air discharged from the accommodating space is introduced and a second housing part connected to the first housing by a hinge; and the first filter unit and the second filter unit are respectively coupled to the first housing part and the second housing part.

13. The clothes treating apparatus of claim 5, wherein the brush is provided within the housing such that the brush is in physical contact with the first filter unit and the second filter unit, the substance removal unit further including a brush rotating shaft coupled to the first filter unit and the second filter unit and connected to the brush to rotate the brush, the clothes treating apparatus further comprising:

a motor external to the housing and including a motor rotating shaft; and gears connecting the brush rotating shaft with the motor rotating shaft.

14. The clothes treating apparatus of claim 13, wherein the motor rotating shaft is placed at an angle with respect to a vertical axis that is centered at a position of the brush rotating shaft.

15. The clothes treating apparatus of claim 14, wherein the angle of placement of the motor rotating shaft has a value that is within a range of 30 to 60 degrees.

16. The clothes treating apparatus of claim 13, wherein the gears include:

a driven gear attached to the brush rotating shaft and placed on the outside of the housing; and a driving gear attached to the motor rotating shaft and engaged with the driven gear.

17. The clothes treating apparatus of claim 13, wherein the gears include:

a driven gear attached to the brush rotating shaft and placed on the outside of the housing;

a driving gear attached to the motor rotating shaft; and a connection gear placed within the duct unit that connects the driven gear and the driving gear.

18. The clothes treating apparatus of claim 13, wherein the brush includes bristles of varying length.

19. The clothes treating apparatus of claim 1, wherein the storage space includes a collection unit coupled to the housing, wherein the collection unit is configured to attach to and detach from the housing.

20. The clothes treating apparatus of claim 1, further comprising a fluid supply unit configured to supply a fluid into the storage space, wherein the housing includes an inlet hole connected to the fluid supply unit and a discharge hole to discharge the substances stored in the storage space to the outside of the housing.

21. The clothes treating apparatus of claim 20, wherein:

the duct unit includes a suction hole into which air discharged from the accommodating space is introduced;

the housing is coupled to the duct unit through the suction hole and includes an inflow surface that is connected to the suction hole and through which air is introduced into the housing; and the storage space includes a collection unit coupled to the housing, the inflow surface and the suction hole being coupled to the collection unit.

22. The clothes treating apparatus of claim 21, wherein:

the duct unit includes a discharge duct into which air removed from the accommodating space is introduced and a supply duct that is connected to the discharge duct and configured to guide air into the accommodating space;

the air supply unit includes a condensing part that is configured to remove moisture from the air introduced into the discharge duct and a heating part to heat the air from which moisture has been removed, the air supply unit configured to supply the heated air to the supply duct; and the fluid supply unit includes a water supply pipe configured to supply condensation water, generated by the condensing part, to the inlet hole.

23. The clothes treating apparatus of claim 1, further comprising a sensing unit configured to determine whether an amount of substances collected in the storage space exceeds a predetermined reference storage amount.

24. The clothes treating apparatus of claim 23, further comprising a display unit configured to inform a user, based on information supplied from the sensing unit, that the amount of the substances collected in the storage space exceeds the reference storage amount.

25. The clothes treating apparatus of claim 23, wherein the sensing unit includes at least one of an angle detection unit configured to sense whether the substance removal unit is rotated within an angle range smaller than a predetermined angle range, a weight sensor configured to measure a weight of the substances collected in the storage space, and an infrared (IR) sensor configured to sense an amount of the substances collected in the storage space.

26. A clothes treating apparatus comprising:

an accommodating space configured to receive one or more clothing articles;

an air supply unit configured to supply air to the accommodating space;

a duct unit configured to guide discharge of air from the accommodating space;

a filter housing that includes a first side with a first filter unit, a second side with a second filter unit, and one or more air inlets that allow air discharged from the accommodating space through the duct unit to enter the filter housing and pass through the first filter unit and the second filter unit, the first filter unit and the second filter unit being configured to filter substances from air passing through the filter housing and the first side of the filter housing being configured to attach to and detach from the second side of the filter housing; and a brush positioned within the filter housing between the first filter unit and the second filter unit when the first side of the filter housing is attached to the second side of the filter housing, the brush being configured to:

rotate back and forth over an angle range that covers less than all of the first filter unit and the second filter unit;

brush substances remaining on the first filter unit and the second filter unit toward a storage space defined within the filter housing, the storage space being located at a portion of the filter housing outside of the angle range through which the brush rotates; and compress substances into the storage space as substances brushed from the first filter unit and the second filter unit fill the storage space and expand into the angle range through which the brush rotates.

27. The clothes treating apparatus of claim 26, wherein:

the storage space includes an overlapping portion that overlaps with the portion of the filter housing from which substances are moved from the first filter unit and the second filter unit by the brush, the overlapping portion being less than all of the storage space;

the storage space includes a non-overlapping portion that does not overlap with the portion of the filter housing from which substances are moved from the first filter unit and the second filter unit by the brush, the non-overlapping portion being less than all of the storage space; and the brush is configured to compress substances collected in the storage space by pressing substances in the overlapping portion of the storage space toward the non-overlapping portion of the storage space.

28. The clothes treating apparatus of claim 26, wherein the brush is configured to rotate back and forth over the angle range such that the brush presses substances moved from the first filter unit and the second filter unit into a first side of the storage space when rotating in a clockwise direction and presses substances moved from the first filter unit and the second filter unit into a second side of the storage space when rotating in a counterclockwise direction.

29. The clothes treating apparatus of claim 26, wherein:

the first filter unit or the second filter unit is formed in a shape in which at least two circular arc having different radiuses of curvature are connected; and the storage space is located in a portion of the filter housing having a largest radius of curvature.

* * * * *